US010731396B2

(12) United States Patent
Attee et al.

(10) Patent No.: US 10,731,396 B2
(45) Date of Patent: Aug. 4, 2020

(54) HATCH POWER LIFT AND LOCKING SYSTEM

(71) Applicant: DTS Enterprises, Inc., Ellsworth, MI (US)

(72) Inventors: Keith S. Attee, Charlevoix, MI (US); Thomas H. Buerkle, Jr., Keewadin, MI (US)

(73) Assignee: DTS Enterprises, Inc., Ellsworth, MI (US)

( * ) Notice: Subject to any disclaimer, the term of this patent is extended or adjusted under 35 U.S.C. 154(b) by 52 days.

(21) Appl. No.: 15/712,275

(22) Filed: Sep. 22, 2017

(65) Prior Publication Data

US 2018/0163453 A1 Jun. 14, 2018

Related U.S. Application Data

(60) Provisional application No. 62/433,426, filed on Dec. 13, 2016.

(51) Int. Cl.
*E05F 15/63* (2015.01)
*E05D 15/40* (2006.01)
(Continued)

(52) U.S. Cl.
CPC ..... *E05F 15/63* (2015.01); *B63B 19/14* (2013.01); *E04D 13/035* (2013.01); *E05D 15/40* (2013.01); *E05F 11/02* (2013.01); *E05F 11/08* (2013.01); *E05F 15/616* (2015.01); *B63B 2019/245* (2013.01); *E05Y 2201/218* (2013.01); *E05Y 2800/122* (2013.01); *E05Y 2900/00* (2013.01); *E05Y 2900/152* (2013.01); *E05Y 2900/50* (2013.01); *E05Y 2900/514* (2013.01); *E05Y 2900/542* (2013.01)

(58) Field of Classification Search
CPC ..... E05F 15/63; E05F 15/616; B63B 19/14
USPC ..... 49/281, 344
See application file for complete search history.

(56) References Cited

U.S. PATENT DOCUMENTS 91,184 A 6/1869 Tucker
2,149,684 A 3/1939 Mccgregor
(Continued)

FOREIGN PATENT DOCUMENTS

DE 102010063824 A1 * 6/2012 ..... E04D 13/0354
DE 102016100956 A1 * 7/2016 ..... E05F 1/10
EP 1801340 A1 * 6/2007 ..... E05D 15/5205

OTHER PUBLICATIONS

Machine translation of EP-1801340-A1.*
International Search Report PCT/US2017/064857, dated Feb. 6, 2018.

*Primary Examiner* — Marcus Menezes
(74) *Attorney, Agent, or Firm* — Fishman Stewart PLLC

(57) ABSTRACT

A hatch power lift and locking system may include a hatch configured to cover an opening, the hatch being pivotable about an axis between a closed position and an open position. The assembly may also include at least one latch dog attached to the hatch, and at least one dog catch pin engaging with the at least one latch dog in the closed position. The at least one latch dog may include a latch slot for receiving the at least one dog catch pin, and a latch catch for engaging the at least one dog catch pin. The assembly may further include an actuator configured to move at least a portion of the hatch between the closed position and the open position.

19 Claims, 28 Drawing Sheets

(51) Int. Cl.

| | |
|---|---|
| ***E04D 13/035*** | (2006.01) |
| ***B63B 19/14*** | (2006.01) |
| ***E05F 11/02*** | (2006.01) |
| ***E05F 11/08*** | (2006.01) |
| ***E05F 15/616*** | (2015.01) |
| *B63B 19/24* | (2006.01) |

(56) References Cited

U.S. PATENT DOCUMENTS

| | | | | |
|---|---|---|---|---|
| 2,221,039 | A | 11/1940 | Babcock | |
| 3,461,607 | A | 8/1969 | Sandow et al. | |
| 3,888,528 | A | 6/1975 | Jericijo | |
| 4,385,580 | A * | 5/1983 | Davidson | E06B 5/01 114/201 R |
| 4,497,135 | A | 2/1985 | Vetter | |
| 4,811,680 | A * | 3/1989 | Genth | B63B 19/14 114/201 R |
| 4,897,959 | A | 2/1990 | Worden | |
| 5,111,615 | A | 5/1992 | Kuhnt et al. | |
| 5,531,045 | A * | 7/1996 | Piltingsrud | E05F 11/34 49/279 |
| 5,581,942 | A * | 12/1996 | Sill | E04D 13/0357 49/153 |
| 5,632,522 | A | 5/1997 | Gaitan et al. | |
| 6,122,863 | A | 9/2000 | Tippin et al. | |
| 6,585,303 | B1 | 7/2003 | Coose et al. | |
| 8,365,470 | B1 | 2/2013 | Campbell et al. | |
| 8,677,689 | B1 * | 3/2014 | Draper | E05F 15/63 49/280 |
| 2007/0261309 | A1 | 11/2007 | Tommell et al. | |
| 2008/0072810 | A1 * | 3/2008 | Forbes | B63B 19/14 114/201 R |
| 2011/0068721 | A1 | 3/2011 | Bochen | |

* cited by examiner

HATCH POWER LIFT AND LOCKING SYSTEM

CROSS-REFERENCE TO RELATED APPLICATIONS

This application claims priority to U.S. Provisional Patent Application No. 62/433,426 filed Dec. 13, 2016, the contents of which are hereby incorporated by reference in its entirety.

TECHNICAL FIELD

The present disclosure relates to generally to methods and systems of power operating devices for hinged hatch or window assemblies, including without limitation, power operating devices that may be used to open or close a hinged hatch or window assembly.

BACKGROUND

Boats commonly include openings that are covered by a hatch, window (e.g., overhead window assemblies), or other various types of barriers covering portals. For purposes of this disclosure, the term "hatch" or "hatches" may be used to refer to such various forms of hatches, windows, openings, and/or related coverings or closures, whether used in connection with a boat or other vehicle or device. Hatches used in connection with boats may, for example, be mounted in the roof (e.g., top) of the boat cabin. Hatches may be oriented either horizontally or vertically, or a combination thereof, and commonly include at least one flexible joint (e.g., hinge) on one side. However, the position, configuration, size, and/or height of a hatch may make it difficult or challenging to reach and/or open. For example, opening a secured hatch manually can commonly require unlatching one or more latch (e.g., "dog") mechanisms, and the hatch may then need to be lifted with one hand while securing a strut with the other hand. Conversely, to secure (e.g., close) a traditional hatch manually often requires holding the hatch with one hand while disengaging a strut with the other hand. After the hatch is closed, the dog commonly must be manually latched to lock down the hatch to secure the opening. If the hatch is not locked down, the boat may be vulnerable to the elements and/or unauthorized access, or the hatch may open inadvertently. Additionally, hinged windshield assemblies (e.g., a specialized window) may pivot at a top position, which can make it difficult to reach and/or open.

It may be desirable to provide, inter alia, a power operated and locking assembly that may address one or more of the aforementioned challenges, and may open and close a hatch and/or automatically lock and secure a hatch when closed.

SUMMARY

In an embodiment, a hatch power lift and locking system may include a hatch configured to cover an opening, the hatch being pivotable about an axis between a closed position and an open position. The assembly may also include at least one latch dog attached to the hatch, and at least one dog catch pin engaging with the at least one latch dog in the closed position. The at least one latch dog may include a latch slot for receiving the at least one dog catch pin, and a latch catch for engaging the at least one dog catch pin. The assembly may further include an actuator configured to move at least a portion of the hatch between the closed position and the open position.

DETAILED DESCRIPTION

Figure 1:
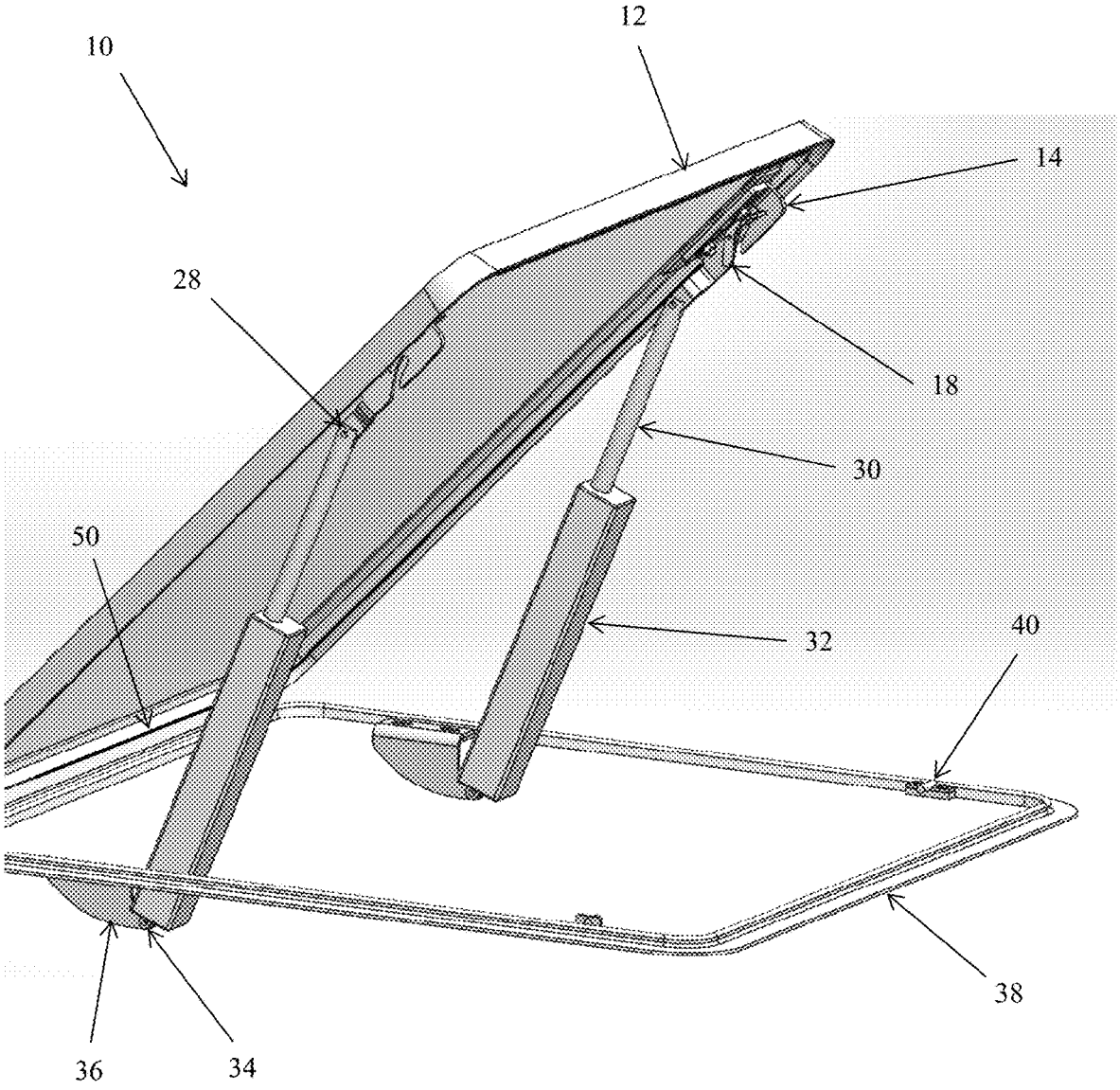
FIG. 1 is a partial perspective view generally illustrating an embodiment of a hatch power lift and locking system in an open position, in accordance with teachings of the present disclosure.
Figure 2:
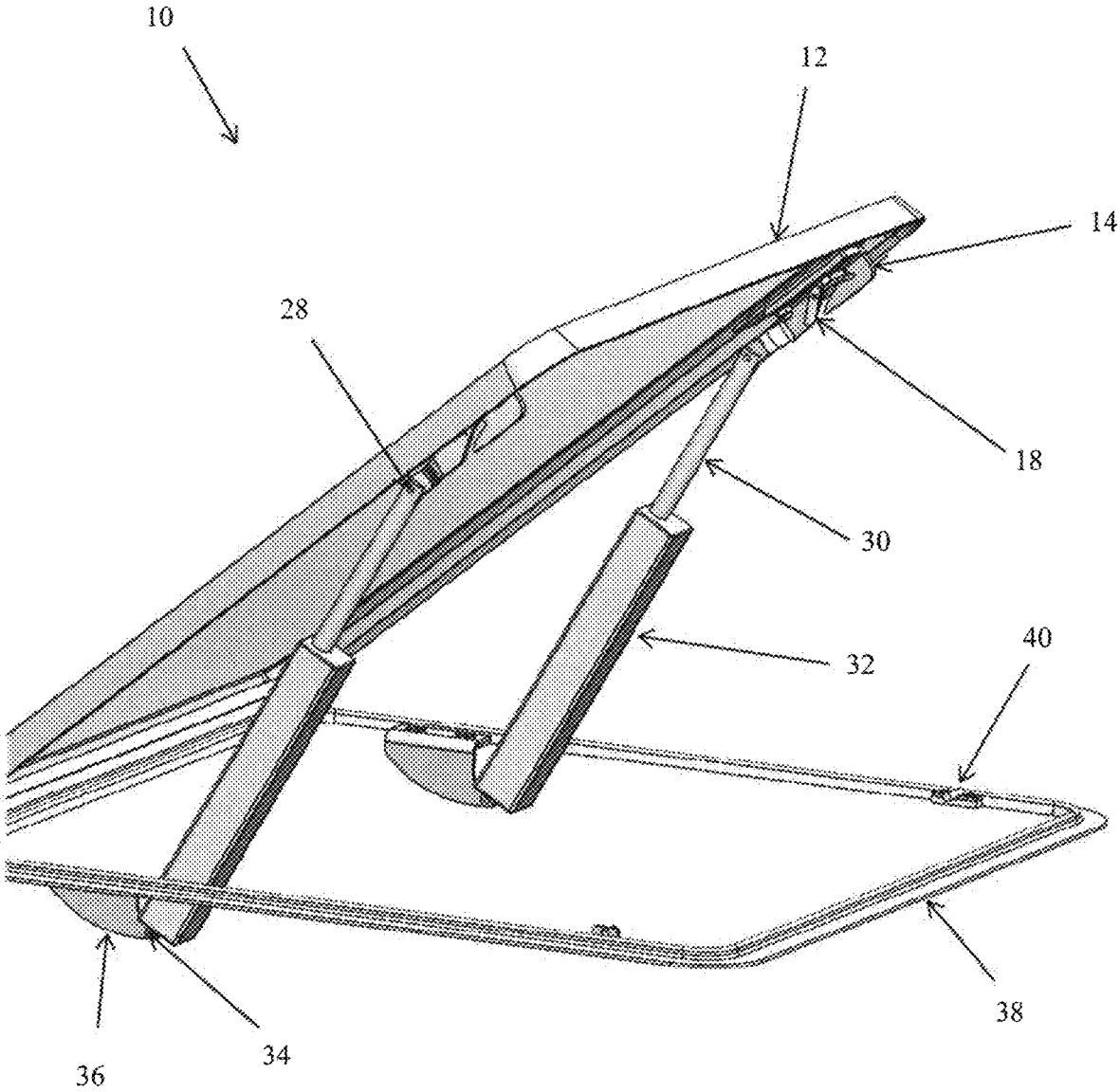
FIG. 2 is a partial perspective view generally illustrating an embodiment of a hatch power lift and locking system in a partially open position, in accordance with teachings of the present disclosure.
Figure 3:
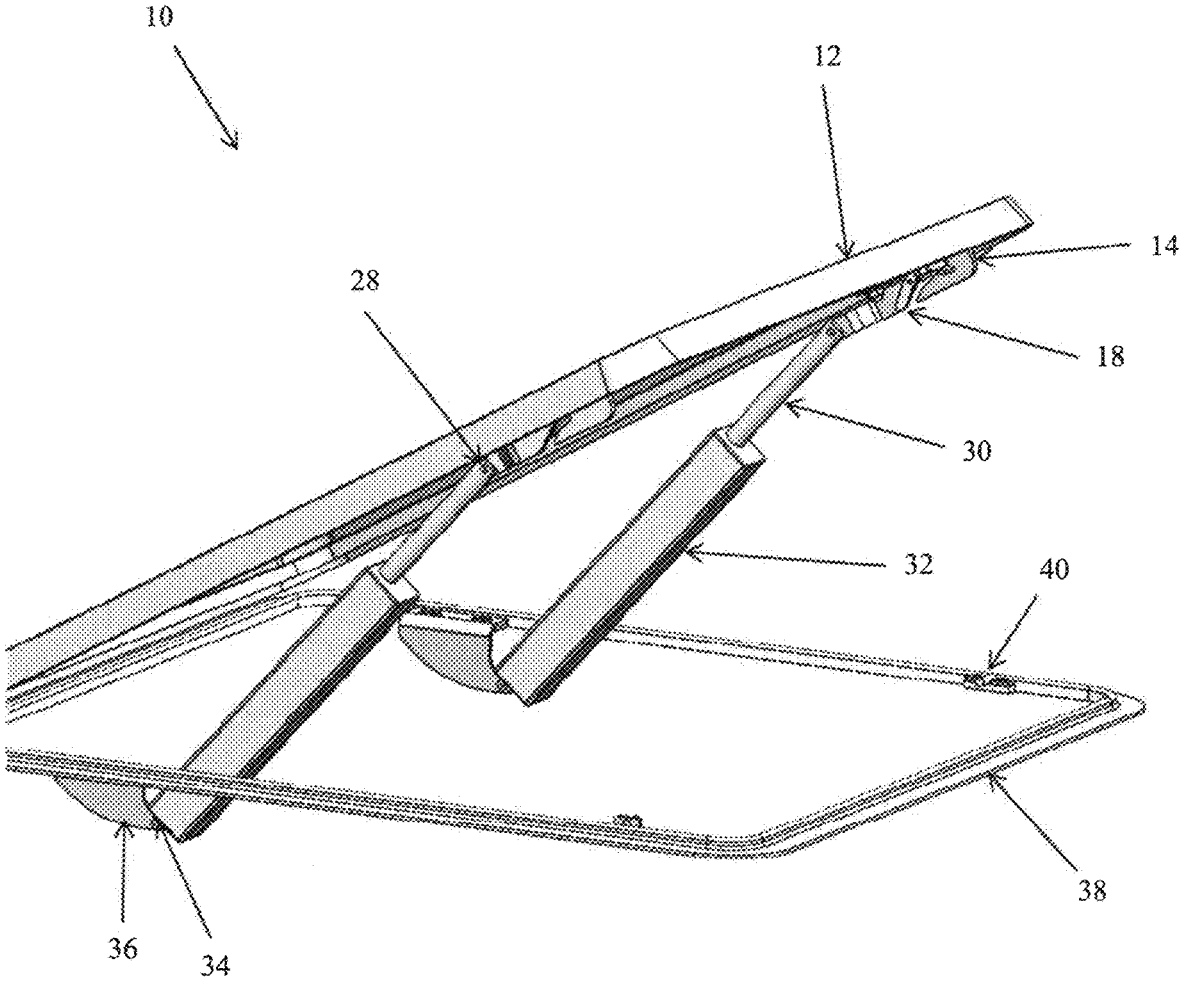
FIG. 3 is a partial perspective view generally illustrating an embodiment of a hatch power lift and locking system in a partially open position, in accordance with teachings of the present disclosure.
Figure 4:
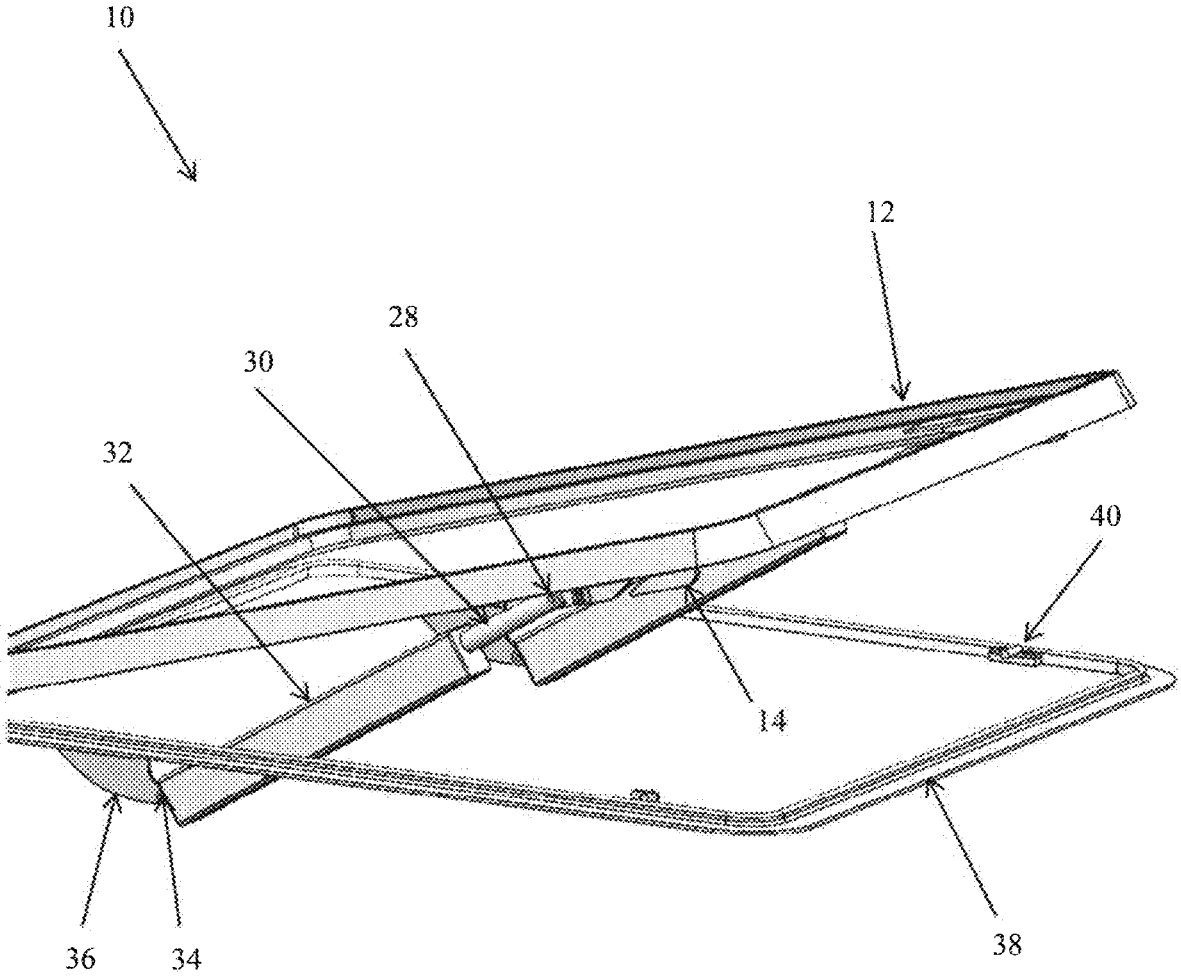
FIG. 4 is a partial perspective view generally illustrating an embodiment of a hatch power lift and locking system in a partially open position, in accordance with teachings of the present disclosure.
Figure 5:
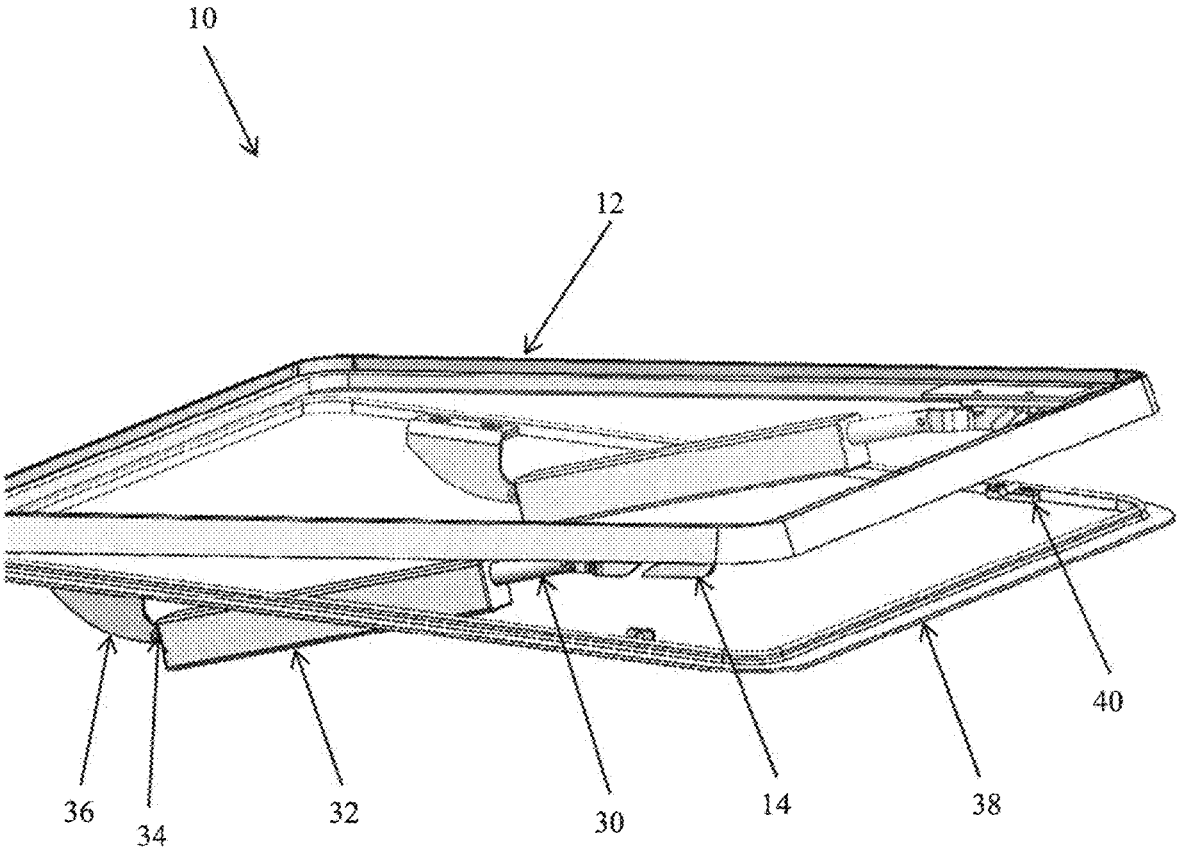
FIG. 5 is a partial perspective view generally illustrating an embodiment of a hatch power lift and locking system in a partially open position, in accordance with teachings of the present disclosure.
Figure 6:
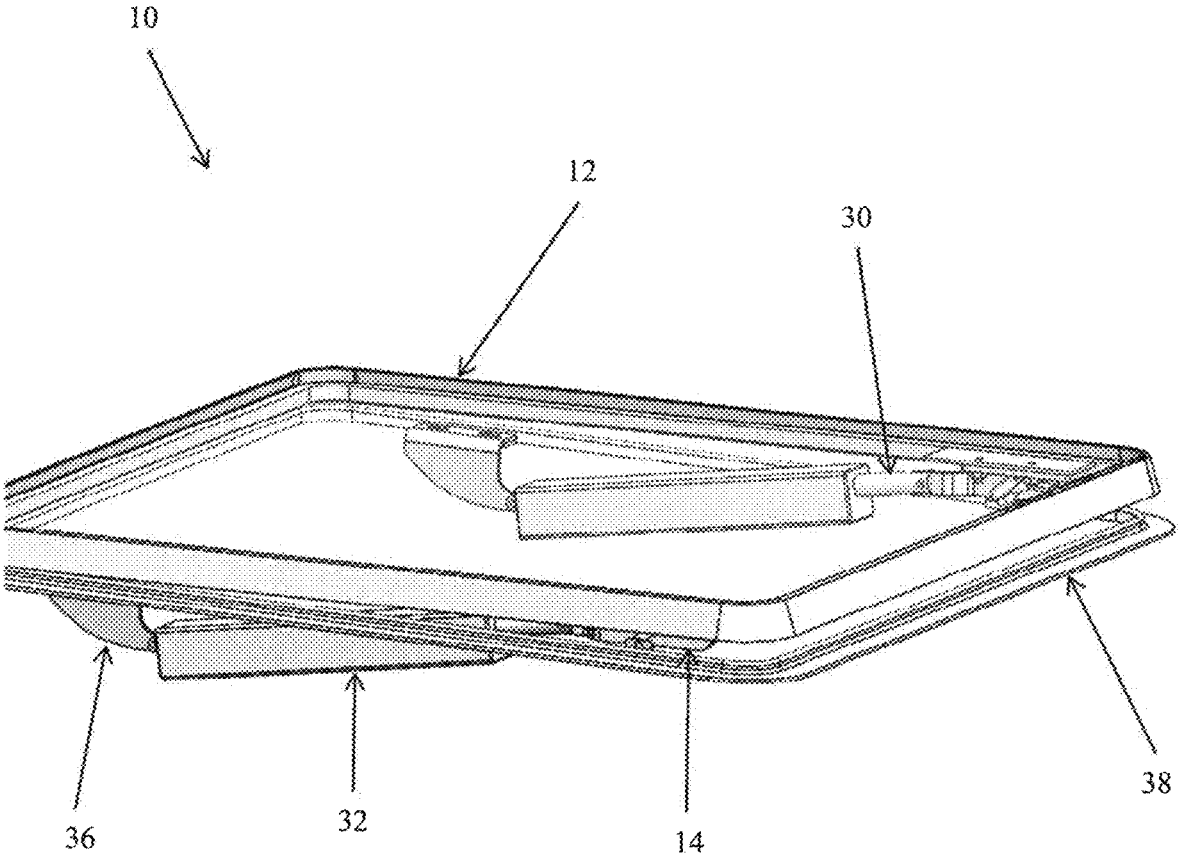
FIG. 6 is a partial perspective view generally illustrating an embodiment of a hatch power lift and locking system in a partially open (near closed) position, in accordance with teachings of the present disclosure.
Figure 7:
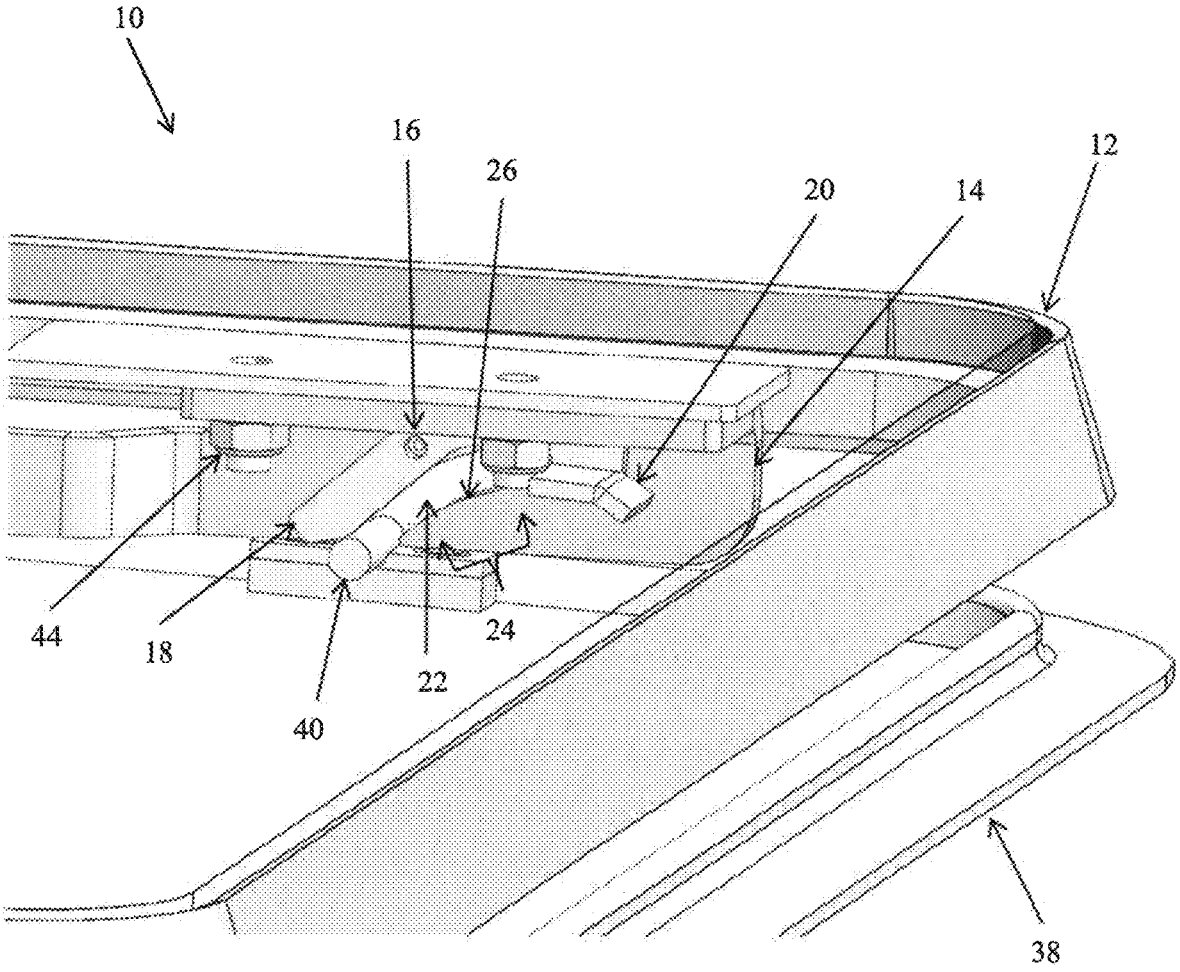
FIG. 7 is a partial perspective view generally illustrating an embodiment of a hatch power lift and locking system in a partially open position, in accordance with teachings of the present disclosure.
Figure 8:
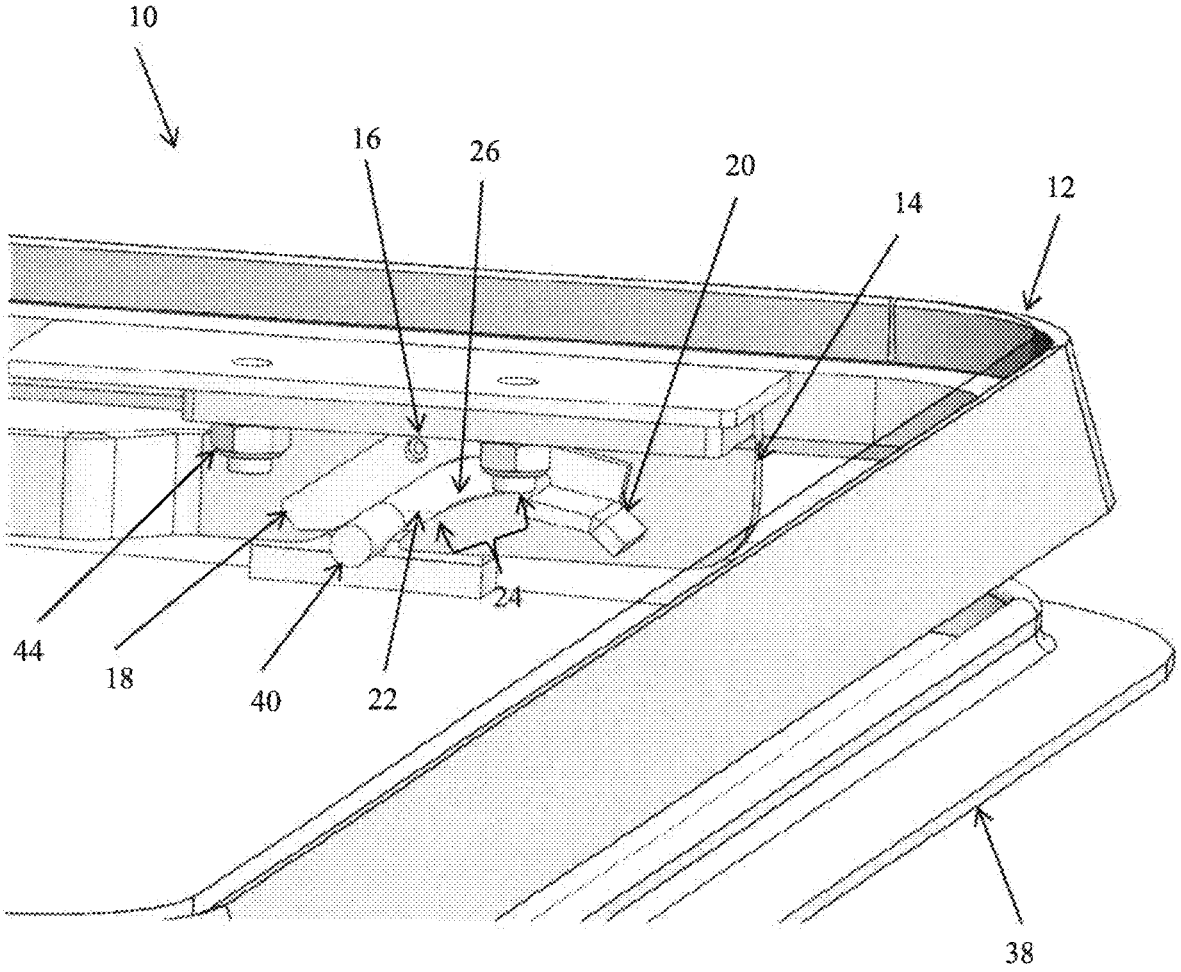
FIG. 8 is a partial perspective view generally illustrating an embodiment of a hatch power lift and locking system in a partially open position, in accordance with teachings of the present disclosure.
Figure 9:
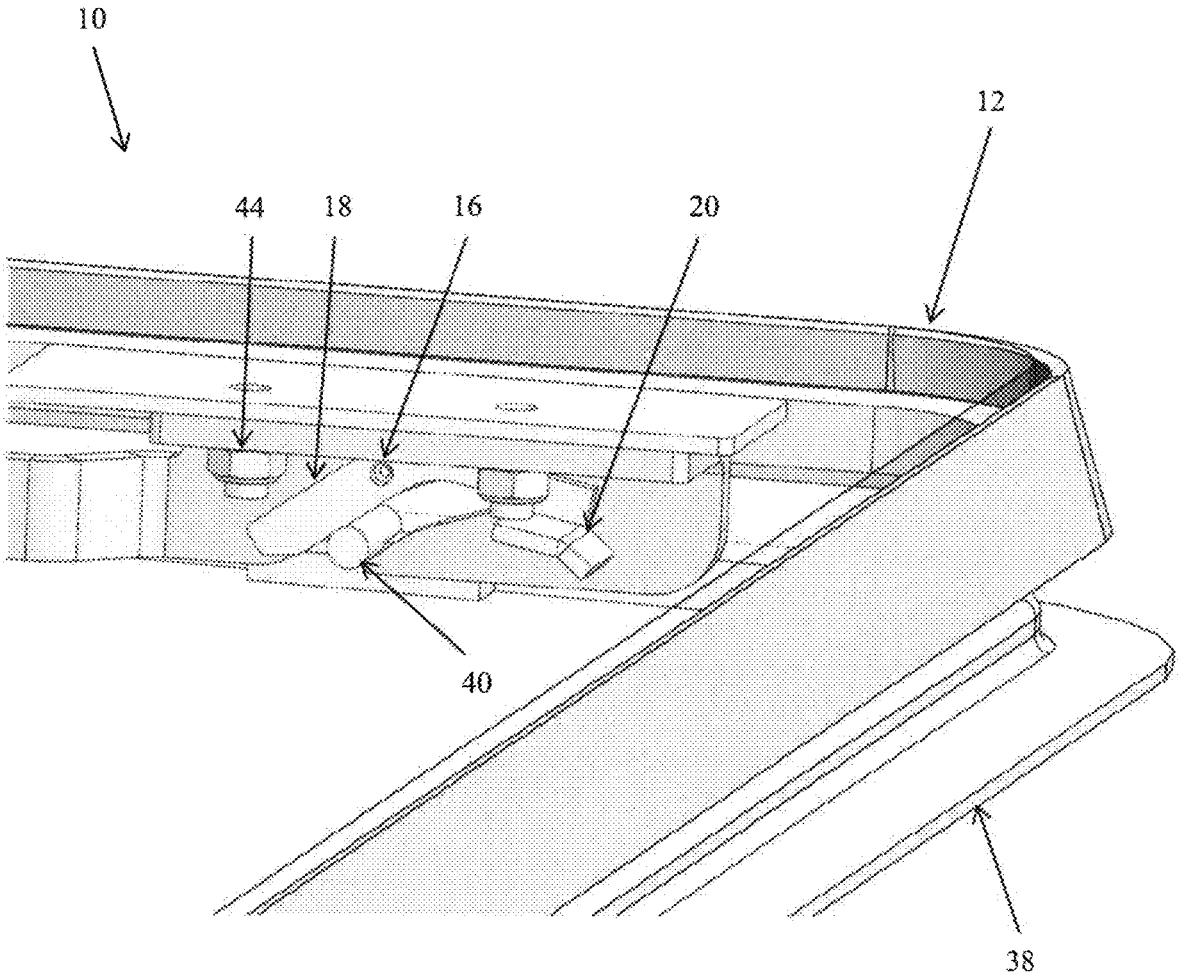
FIG. 9 is a partial perspective view generally illustrating an embodiment of a hatch power lift and locking system in a partially open position, in accordance with teachings of the present disclosure.
Figure 10:
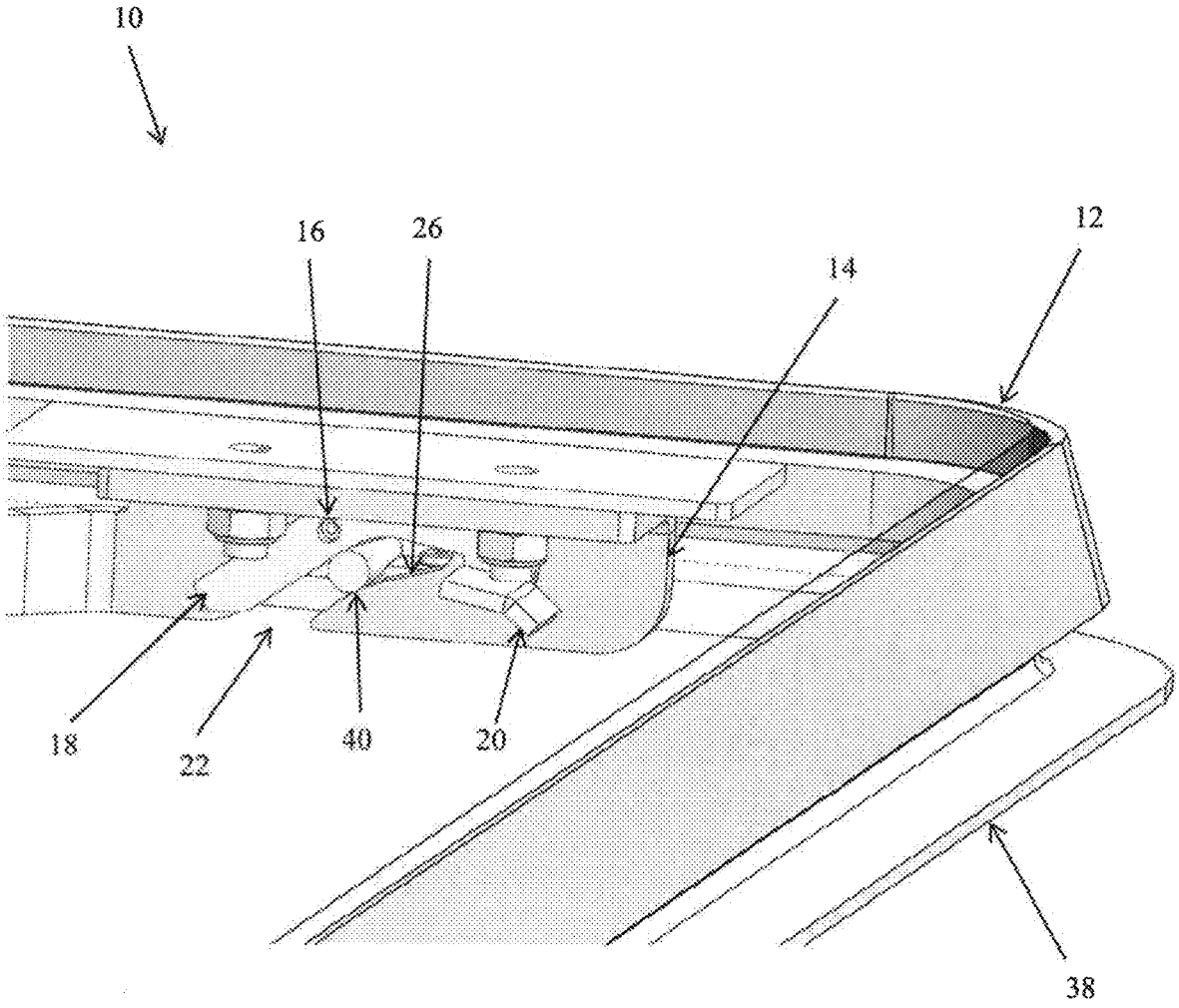
FIG. 10 is a partial perspective view generally illustrating an embodiment of a hatch power lift and locking system in a partially open position, in accordance with teachings of the present disclosure.
Figure 11:
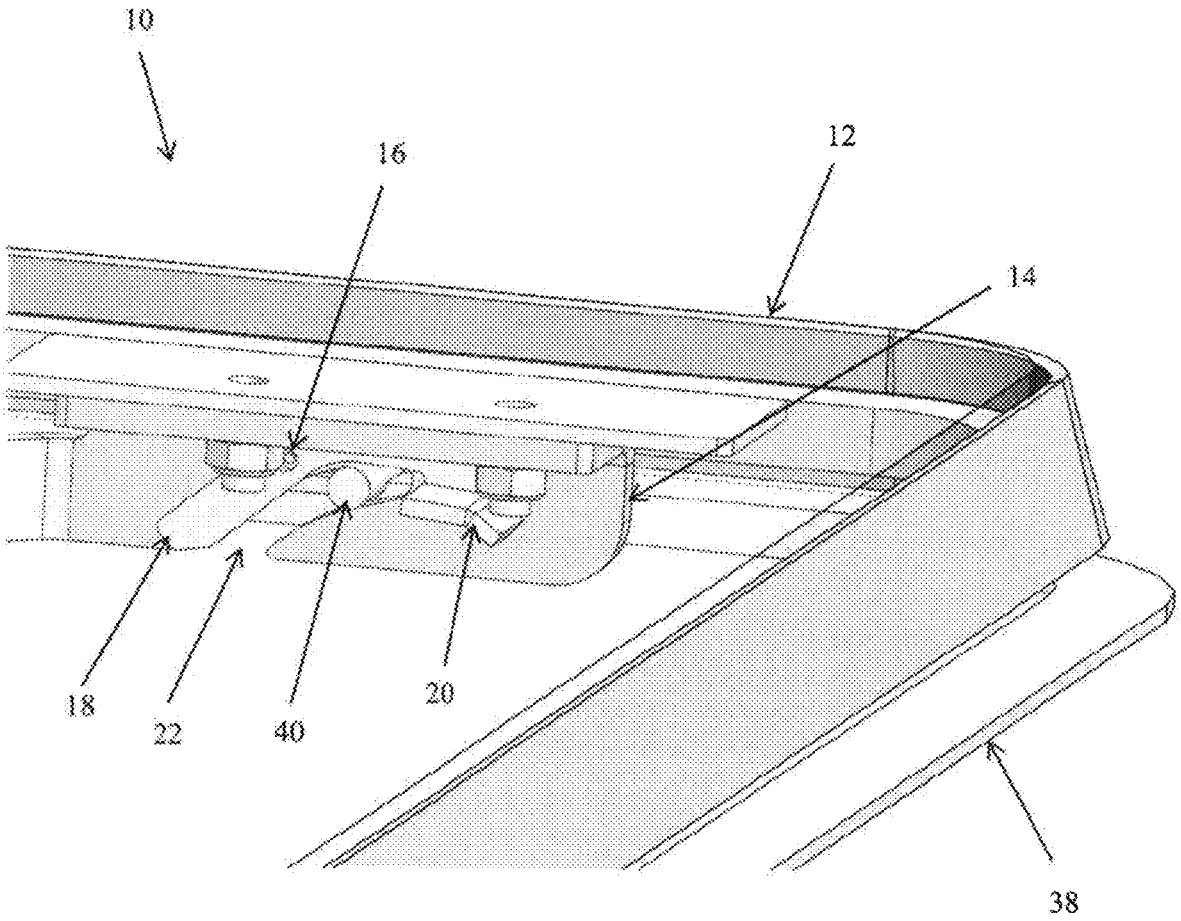
FIG. 11 is a partial perspective view generally illustrating an embodiment of a hatch power lift and locking system in a partially open position, in accordance with teachings of the present disclosure.

Referring now to the drawings, FIGS. 1-28 generally illustrate embodiments of a hatch power lift and locking system 10. As generally illustrated, embodiments of a hatch power lift and locking system 10 may include one or more hatches (or "hatch assemblies") 12, one or more latch dogs 14, one or more latch catch axles 16, one or more latch catches 18, one or more latch catch stops 20, one or more latch grooves/slots 22, one or more latch groove/slot profiles 24, one or more latch groove/slot surfaces 26, one or more shaft axles 28, one or more shafts 30, one or more actuators 32, one or more actuator axles 34, one or more actuator mounting brackets 36, one or more hatch frame 38, one or more dog catch pins 40, one or more latch dog covers 42, one or more fasteners 44, and/or one or more fastener slots 45.

In embodiments, a hatch power lift and locking system 10 may include one or more hatch assemblies 12. Hatch assembly 12 may include one or more flexible joints (e.g., hinges or flex portions) that may permit hatch assembly 12 to pivot (e.g., rotate) about an axis that may pass through the one or more hinges. Hatch assembly 12 may include one or more latch dogs 14. Hatch assembly 12 may include one or more seals 50 configured for sealing portions of a hatch or hatch assembly against at least a portion of one or more hatch frames 38.

In embodiments, a hatch power lift and locking system 10 may include one or more latch dogs 14 that may be configured to engage (e.g., connect to or with) one or more hatch assemblies 12. Latch dogs 14 may, for example, engage hatch assembly 12 via one or more fasteners 44 (e.g., bolts, rivets). For example and without limitation, in embodiments, latch dogs 14 may include one or more latch catch axles 16, one or more latch catches 18, one or more latch catch stops 20, one or more latch groove/slot (also simply referred to as a "slot") 22, one or more latch slot profiles 24, one or more latch slot surfaces 26, one or more shaft axles 28, and/or one or more fastener slots 45.

In embodiments, a hatch power lift and locking system 10 may include a latch catch axle 16 that may be configured to secure a latch catch 18 to a latch dog 14. Latch catch axle 16 may be configured to permit latch catch 18 to rotate (e.g., pivot) relative to latch dog 14 and/or latch slot 22. Latch catch 18 may be engaged by latch catch stop 20 on latch dog 14 and/or dog catch pin 40 on hatch frame 38. Latch catch 18 may rotate (e.g., pivot) about latch catch axle 16 as dog catch pin 40 may engage latch catch 18. Latch catch 18 may be configured to engage a latch catch stop 20 that may be included on latch dog 14. In embodiments, a latch catch axle 16 may include a spring and/or biasing mechanism that may limit and/or control the movement (e.g., rotation) of a latch catch 18. In embodiments, the latch catch 18 and latch catch stop 20 may, and generally solely, be configured to hold the latch dog 14 from sliding when the hatch is open. A dog catch pin 40 may release it when closing the hatch, permitting the latch dog 14 to slide. With the hatch open, and when dog catch pin 40 is not in contact with latch catch 18, latch catch 18 or latch catch stop 20 can rotate (e.g., spring loaded) and engage fasteners 44 and/or fastener slots 45. All other movement and contact is generally only to clear other parts. Such a feature may or may not be necessary for particular applications. Without such a feature, a hatch may have the ability to move (e.g., open) via wind or sudden vehicle motion, such as "falling" off a wave.

In embodiments, a hatch power lift and locking system 10 may be configured to have a latch dog 14 that includes a latch slot 22. For example, latch slot 22 may include a latch slot profile (e.g., contour) 24, and/or a latch slot surface 26. Latch slot profile 24 may be configured to engage (e.g., receive) a dog catch pin 40 that may be included in a hatch frame 38. Latch slot profile 24 may include one or more latch slot surfaces 26. For example and without limitation, a first latch slot surface 26 may have a first angle (e.g., slope, grade) relative to latch dog 14. A second latch slot surface 26 may have a second angle relative to latch dog 14. Additional latch slot surfaces 26 may be contemplated to further engage (e.g., guide) the movement of dog catch pin 40 within latch slot 22. In embodiments, a latch slot 22, a latch slot profile 24, and/or a latch slot surface 26 may permit a dog catch pin 40 to engage a latch dog 14, and/or a latch catch 18.

In embodiments, a hatch power lift and locking system 10 may be configured to have a latch dog 14 that includes one or more fasteners 44 that may engage one or more fastener slots 45. Fastener slots 45 may be configured to permit latch dog 14 to move (e.g., slide) relative to a hatch assembly 12 of a hatch power lift and locking system 10. For example, in a closing operation, as a dog catch pin 40 engages a latch slot 22, latch dog 14 may slide relative to fasteners 44 via fastener slots 45 (see FIGS. 23-25). Fastener slots 45 may permit movement of latch dog 14 relative to hatch assembly 12 as latch slot 22 engages dog catch pin 40. In a closing operation, retraction of actuator 32 may slide and/or pull latch dog 14 toward actuator 32 relative to fastener slots 45. In other words, movement (e.g., travel) of actuator 32 may be affected by the dimension (e.g., length) of fastener slots 45 in both closing and opening operations.

In embodiments, a hatch power lift and locking system 10 may include a latch dog 14 that may include a shaft axle 28. Shaft axle 28 may be configured to engage a shaft 30 and/or an actuator 32 that may be connected to a bracket 36 and/or a hatch frame 38. Shaft axle 28 may be configured to permit shaft 30 and/or actuator 32 to rotate (e.g., pivot) relative to latch dog 14. Shaft axle 28 may include a fastener (e.g., bolt, screw, cotter pin) 44 that may include and/or incorporate a rotational surface (e.g., bushing, bearing). It is noted that there can be a relationship between the fasteners 44 to fastener slots 45 in a latch dog 14. For example, fastener slot 45 may be configured to permit a latch dog 14 to slide via one or more fasteners 44 relative to hatch assembly 12. When opening, an end of fastener slot 45 in a latch dog 14 may, inter alia, serve as a travel limit with respect to fasteners and may start an opening sequence. In an embodiment, prior to an opening sequence, a latch dog 14 may slide, and may not be rigidly attached to the hatch assembly 12 (e.g., lid). A combination comprising an end of a slot and a latch catch 18 may be configured to engage a latch catch stop 20 to provide or create a "rigid" attachment when the hatch is opening. So, with some embodiments, it can seem like there are two distinct stages—for example, a coarse opening/closing (e.g., involving significant motion) and a dog opening/closing (e.g., involving a slight, but powerful motion).

In embodiments, a hatch power lift and locking system 10 may include a shaft 30 that may engage a shaft axle 28, an actuator 32, a bracket 36, and/or a hatch frame 38. Shaft 30 may be configured to engage shaft axle 28 via a passage (e.g., hole) that may receive at least a portion of shaft axle 28 and may be configured to connect shaft 30 with latch dog 14. Shaft 30 may be configured to engage actuator 32 via a mechanical and/or electrical connection (e.g., threaded rod, linear motor, pneumatic cylinder). Shaft 30 may be configured to be at least partially retracted and/or extended within at least a portion of actuator 32. In embodiments, portions of shaft 30 may be collapsible (e.g., segmented) into itself and/or actuator 32. Shaft 30 may include detents (e.g., notches) at predetermined intervals that may permit the movement (e.g., retraction, extension) of shaft 30 to be stopped and/or momentarily halted. For example and without limitation, shaft 30 may include one or more detents to halt the movement of a hatch assembly 12 at predetermined angles (e.g., 20 degrees, 45 degrees, 60 degrees) or increments relative to a hatch frame 38.

In embodiments, a hatch power lift and locking system 10 may include an actuator 32 that may engage a latch dog 14, a shaft 30, a bracket 36, and/or a hatch frame 38. Actuator 32 may be configured to operate (e.g., retract, extend) shaft 30 via a mechanical and/or electrical (e.g., threaded rod, linear motor, pneumatic cylinder) system. Actuator 32 may be controlled via a mechanical and/or electrical control system. Actuator 32 may include an onboard power source (e.g., battery, capacitor). Actuator 32 may be configured to connect to a vehicle (e.g., boat, recreational vehicle "RV") power system that may include electrical and/or mechanical (e.g., pneumatic, hydraulic) power supplies and/or sources. Actuator 32 may be configured to be controlled at least partially and/or optionally via other on-board or remote electrical and/or mechanical systems (e.g., rain sensors, alarm systems, gyroscopes, computer programs). Actuator 32 may include safety mechanisms (e.g., overload, limit switches) that may halt and/or reverse the operation of actuator 32 according to predetermined characteristics (e.g., obstacle in path of hatch assembly 12, predetermined actuating load exceeded).

For example, actuator 32 may be controlled via wiring to a switch (e.g., toggle, dial) located on a vehicle component (e.g., dashboard, wall). Additionally and alternatively, actuator 32 may be controlled via a wireless connection (e.g., Bluetooth™, Wi-Fi, radio frequency). For example and without limitation, an actuator 32 may be controlled remotely via a mobile device (e.g., "smart" phone, laptop computer). A computer program (e.g., an application) may be installed on the mobile device that may detect and/or operate one or more actuators 32. Additionally and alternatively, actuator 32 may be connected to a vehicle (e.g., boat, RV) climate control and/or security system. The climate control and/or security system may automatically and/or via operator direction activate one or more actuators 32 that may result in the retraction and/or extension of one or more hatch assemblies.

In embodiments, actuator 32 may be configured (e.g., attached) to engage a bracket 36 and/or a hatch frame 38 via an actuator axle 34. Actuator axle 34 may be configured to permit the movement (e.g., rotation) of actuator 32 relative to bracket 36 and/or hatch frame 38. Actuator 32 may be configured to engage actuator axle 34 via a passage (e.g., hole) that may receive at least a portion of actuator axle 28 and may be configured to engage actuator 32 with bracket 36 and/or hatch frame 38.

In embodiments, a hatch power lift and locking system 10 may include a bracket 36 that may be configured to engage an actuator 32, an actuator axle 34, and/or a hatch frame 38. Bracket 36 may be configured to permit the rotation (e.g., movement) of shaft 30, actuator 32 and/or actuator axle 34. Bracket 36 may include a rotational element (e.g., bushing, bearing) that may engage shaft 30, actuator 32, and/or actuator axle 34. In embodiments, bracket 36 may integrated into and/or omitted by including one or more elements of bracket 36 into a shaft 30, an actuator 32, and/or a hatch frame 38.

In embodiments, a hatch power lift and locking system 10 may include one or more hatch frames 38. Hatch frame 38 may be configured to engage a hatch assembly 12. Hatch frame 38 may include one or more seals 50 that may engage one or more hatch assemblies 12. Hatch frame 38 may include one or more flexible joints (e.g., hinges) that may permit hatch frame 38 to pivot (e.g., rotate) about an axis that may pass through the one or more hinges. In embodiments, a hatch frame 38 may be configured with one or more dog catch pins 40 that may be configured to engage one or more latch dogs 14, one or more latch catches 18, one or more slots 22, one or more slot profiles 24, and/or one or more slot surfaces 26.

In embodiments, a hatch power lift and locking system 10 may include one or more dog catch pins 40. Dog catch pins 40 may be configured for engagement with a hatch frame 38. In embodiments, dog catch pins 40 may be configured for engagement along at least a portion of latch slot 22, including slot profile 24, and slot surface 26. For example and without limitation, if hatch assembly 12 may be approaching hatch frame 38 during a closing (e.g., dogging) sequence, dog catch pin 40 may engage latch catch 18 and/or latch slot 22 and may permit travel (e.g., movement along) a path defined by latch catch 18 and/or latch slot 22. In embodiments, latch catch axle 16 and/or latch catch 18 may be configured with spring and/or biasing mechanisms to affect the position of dog catch pins 40 to a predetermined position, such as during an opening and/or closing sequence, when dog catch pins 40 may disengage (e.g., be clear of) latch catch 18 and/or latch slot 22.

In embodiments, a hatch power lift and locking system 10 may include one or more latch dog covers 42. Latch dog covers 42 may be configured to at least partially enclose (e.g., cover) one or more latch dogs 14 on a hatch assembly 12. Latch dog covers 42 may be configured to prevent foreign objects (e.g., dirt, fingers) from entering area surrounding latch dogs 14 and including latch catches 18, latch catch stops 20, latch slots 22, latch slot profiles 24, and/or latch slot surfaces 26. Latch dog covers 42 may be secured to latch dogs 14 via frictional and/or interference fit. In embodiments, latch dog covers 42 may include magnets that may engage one or more surfaces of hatch assembly 12 and/or latch dogs 14.

Figure 13:
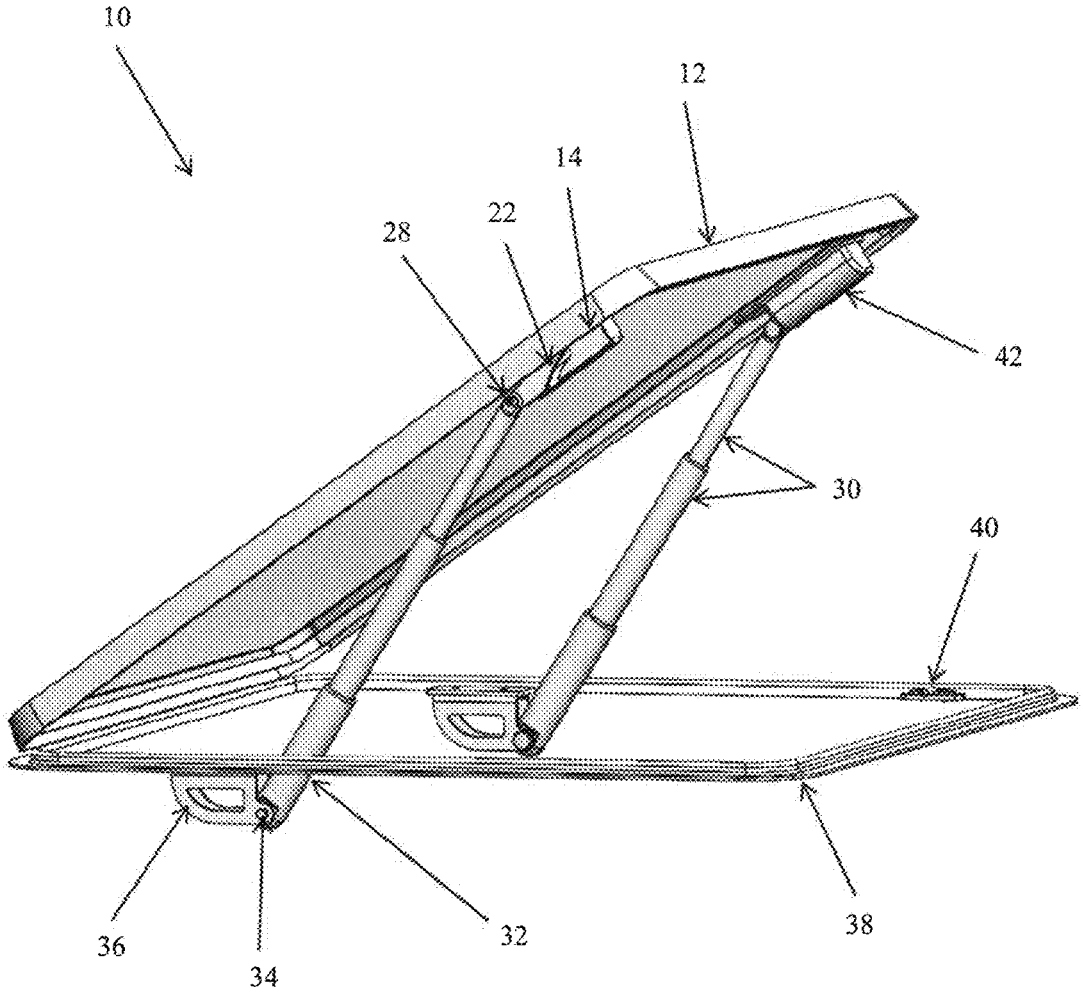
FIG. 13 is a partial perspective view generally illustrating an embodiment of a hatch power lift and locking system in an open position, in accordance with teachings of the present disclosure.
Figure 14:
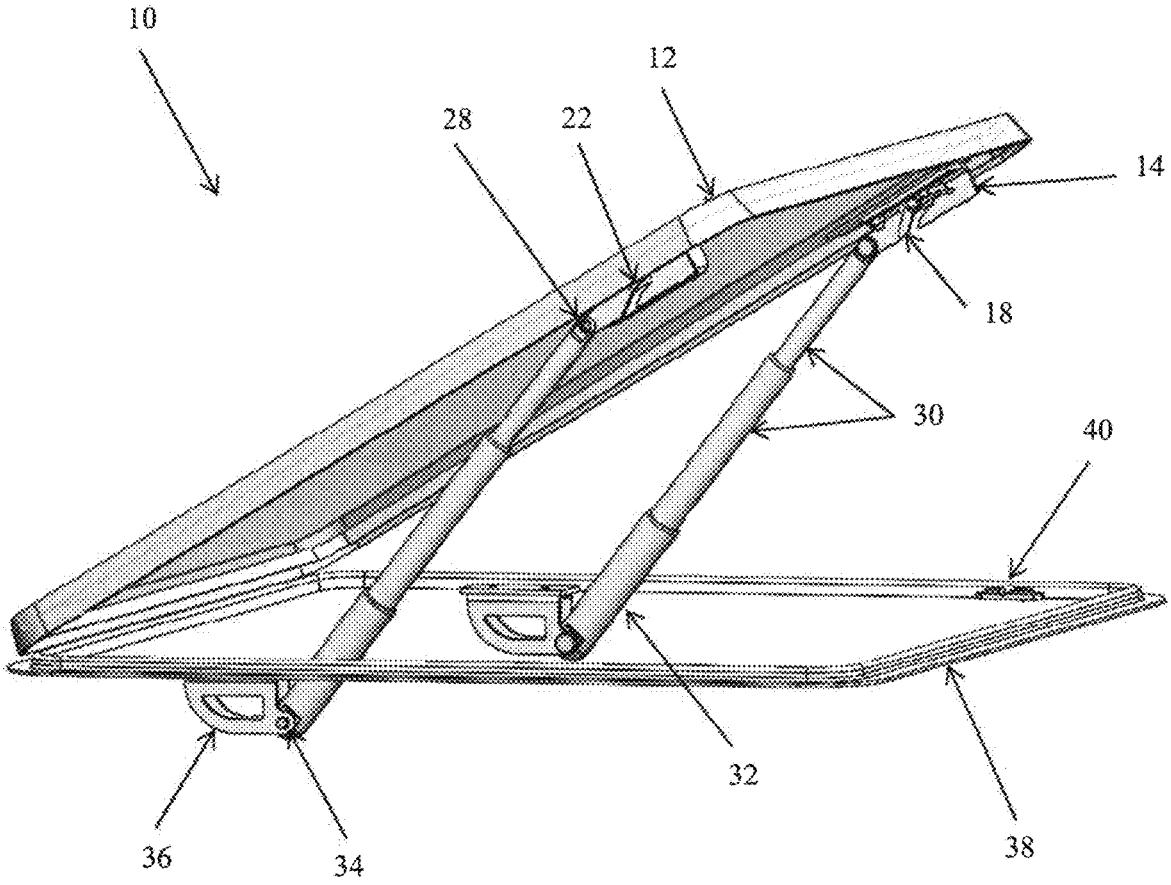
FIG. 14 is a partial perspective view generally illustrating an embodiment of a hatch power lift and locking system in a partially open position, in accordance with teachings of the present disclosure.
Figure 15:
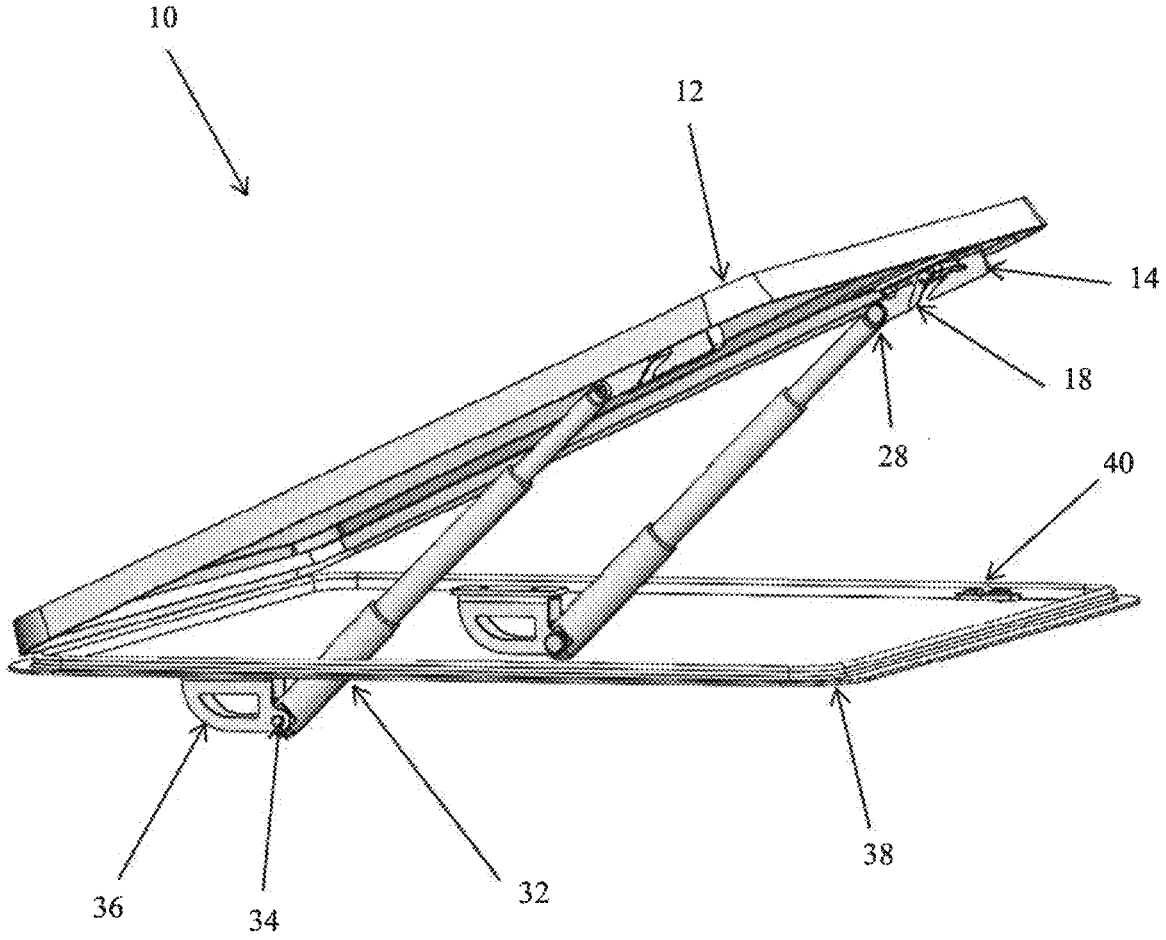
FIG. 15 is a partial perspective view generally illustrating an embodiment of a hatch power lift and locking system in a partially open position, in accordance with teachings of the present disclosure.
Figure 16:
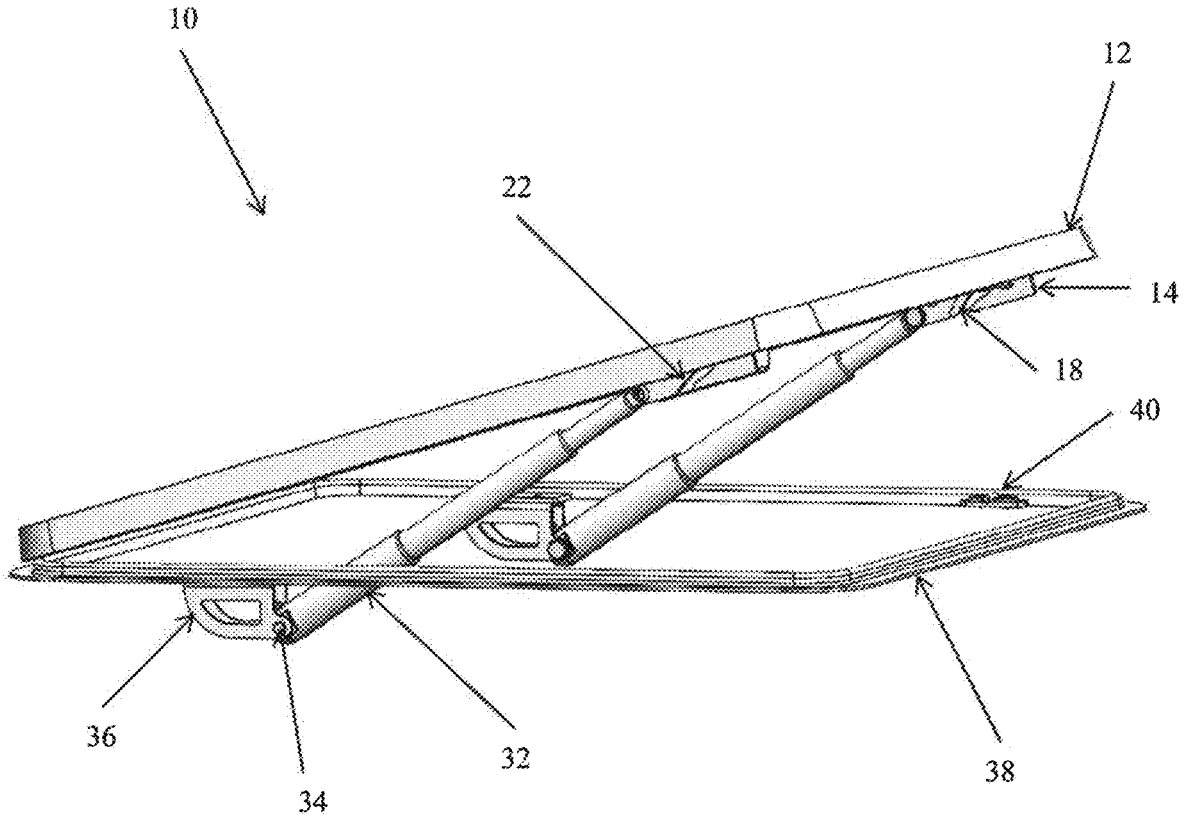
FIG. 16 is a partial perspective view generally illustrating an embodiment of a hatch power lift and locking system in a partially open position, in accordance with teachings of the present disclosure.
Figure 17:
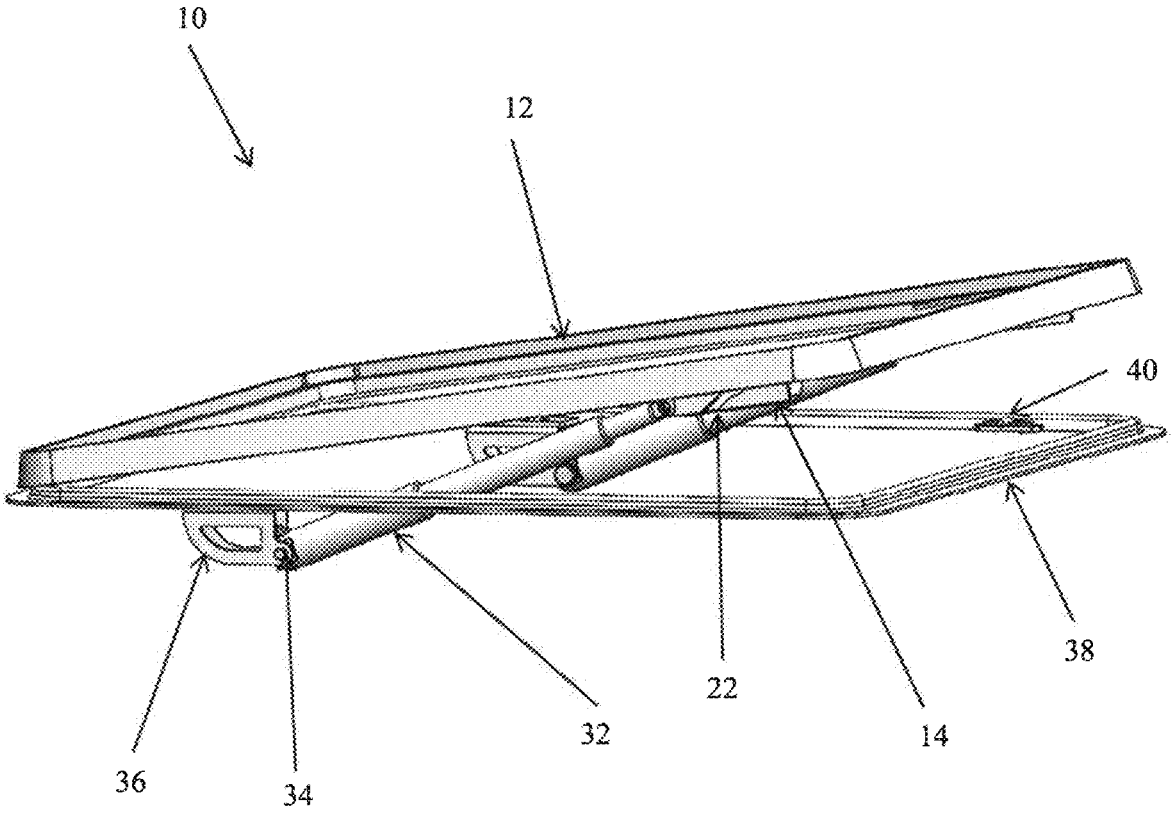
FIG. 17 is a partial perspective view generally illustrating an embodiment of a hatch power lift and locking system in a partially open position, in accordance with teachings of the present disclosure.
Figure 18:
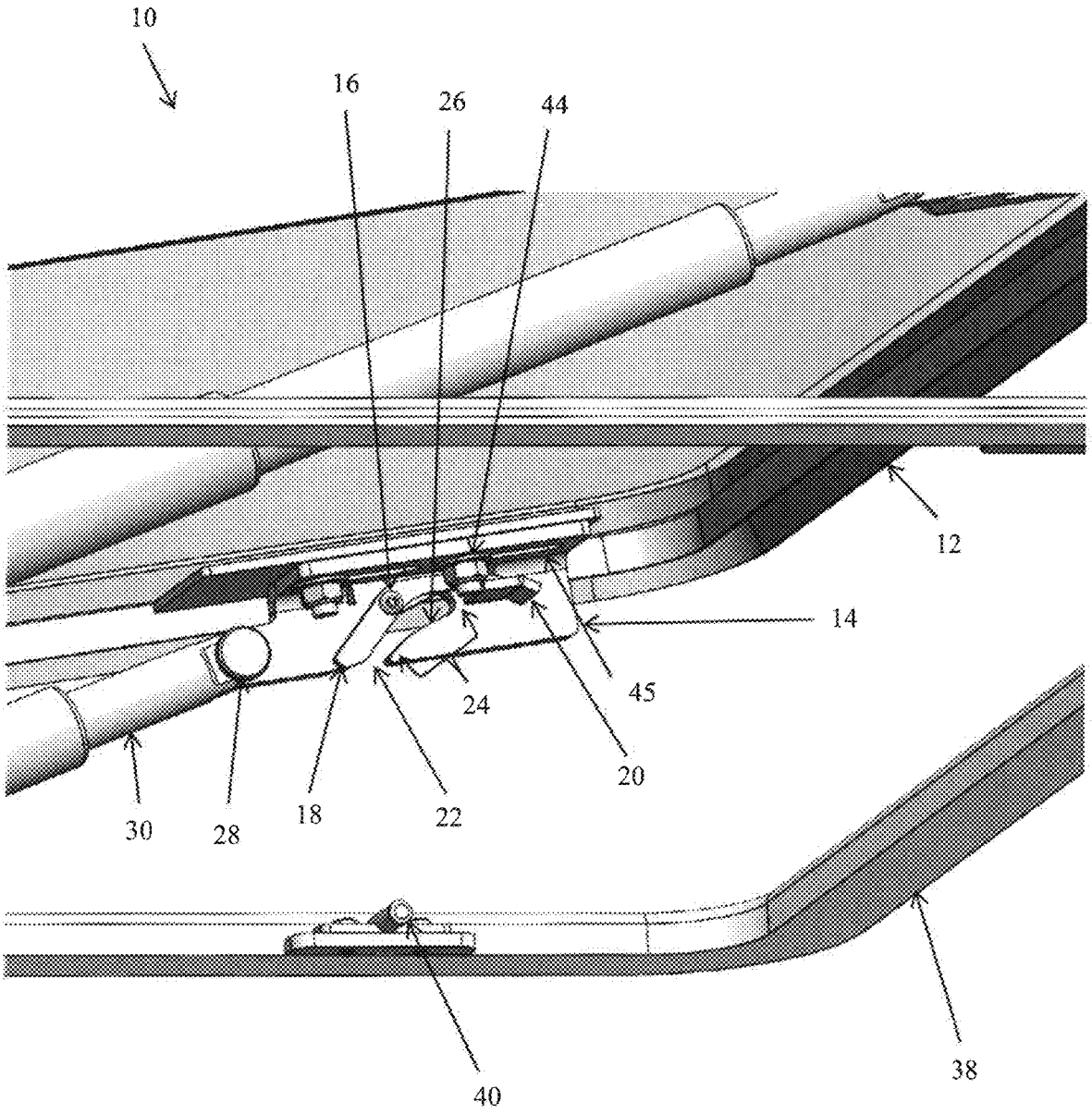
FIG. 18 is a partial perspective view generally illustrating an embodiment of a hatch power lift and locking system in a partially open position, in accordance with teachings of the present disclosure.
Figure 19:
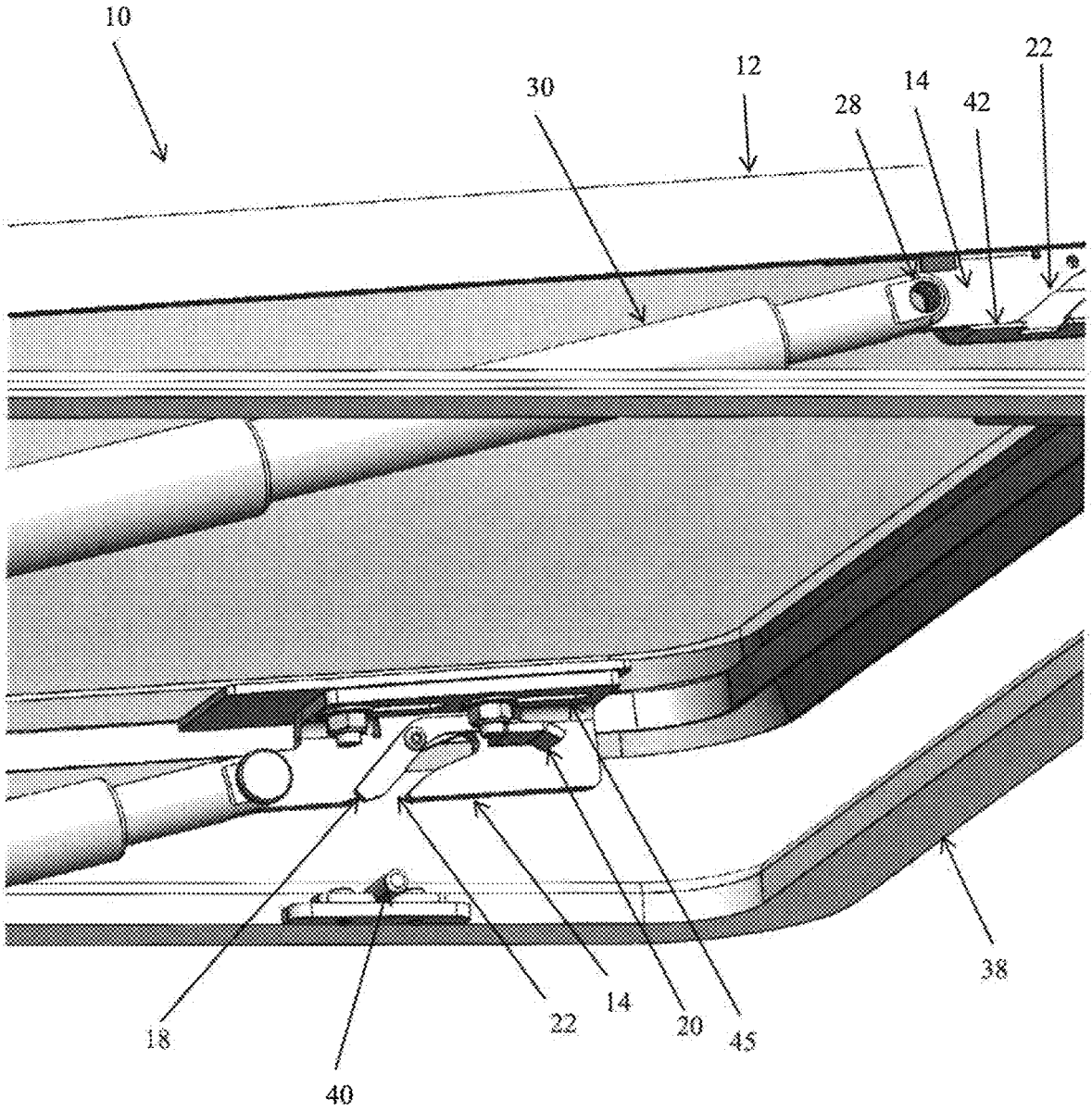
FIG. 19 is a partial perspective view generally illustrating an embodiment of a hatch power lift and locking system in a partially open position, in accordance with teachings of the present disclosure.
Figure 20:
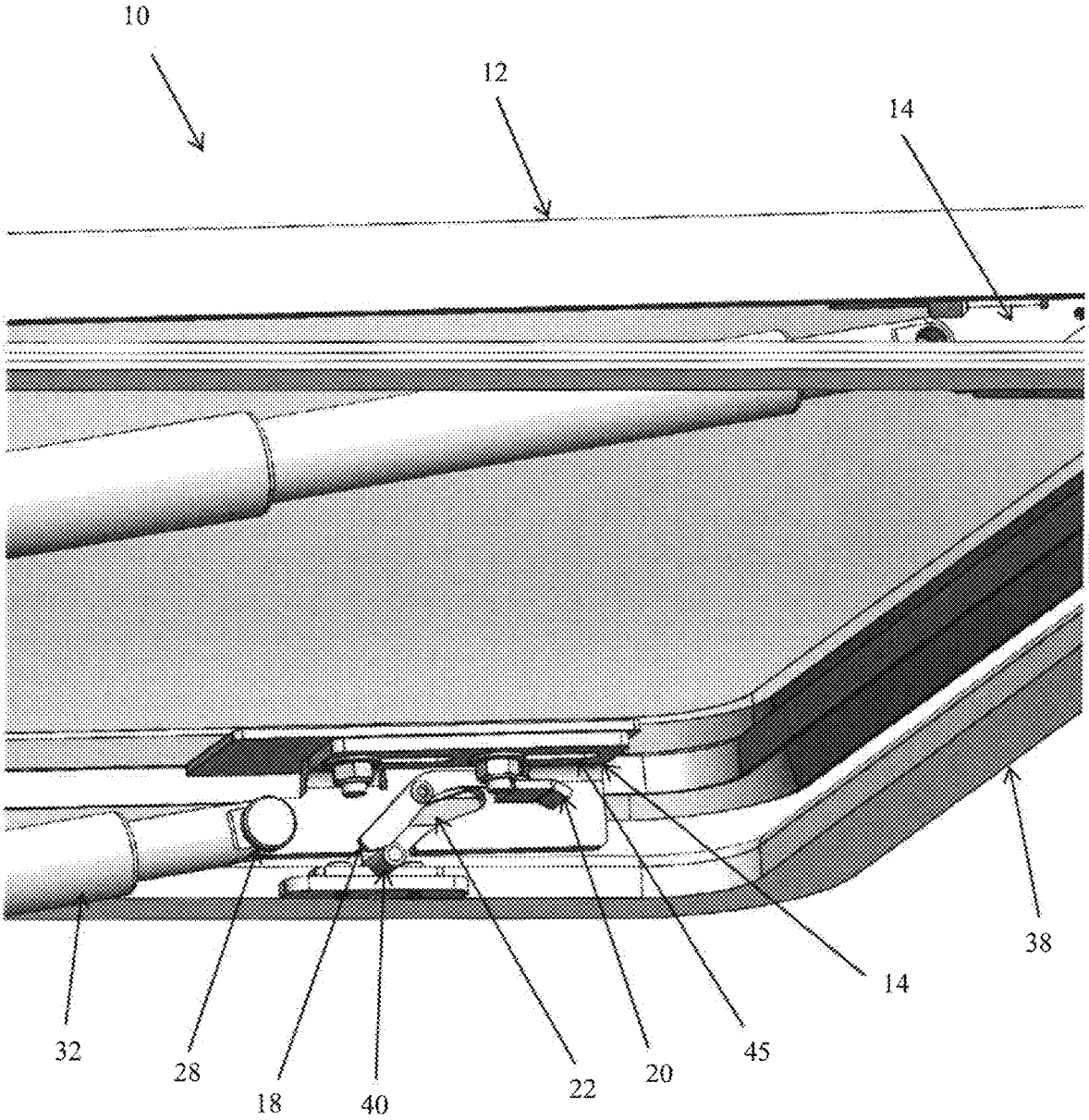
FIG. 20 is a partial perspective view generally illustrating an embodiment of a hatch power lift and locking system in a partially open position, in accordance with teachings of the present disclosure.
Figure 21:
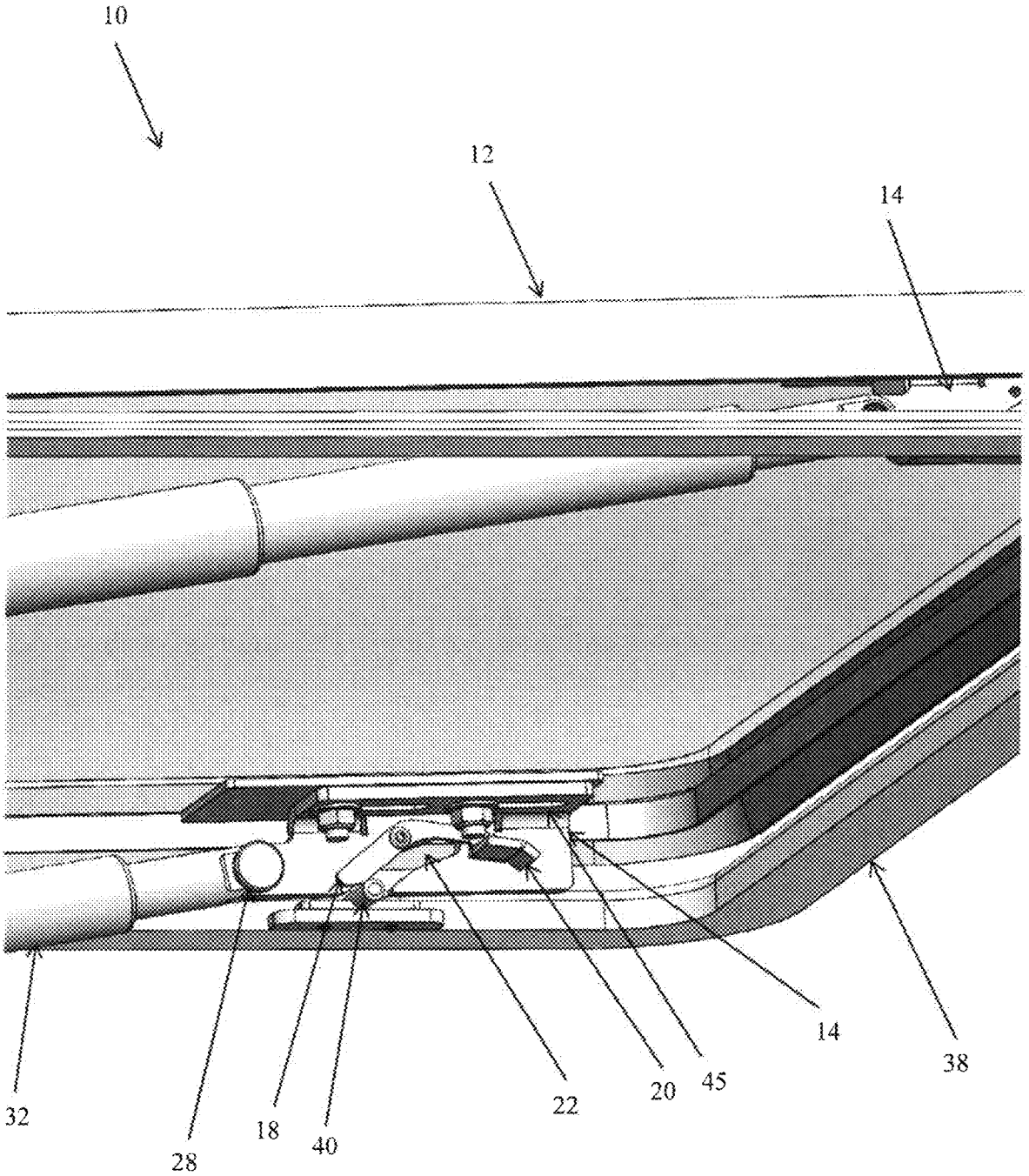
FIG. 21 is a partial perspective view generally illustrating an embodiment of a hatch power lift and locking system in a partially open position, in accordance with teachings of the present disclosure.
Figure 22:
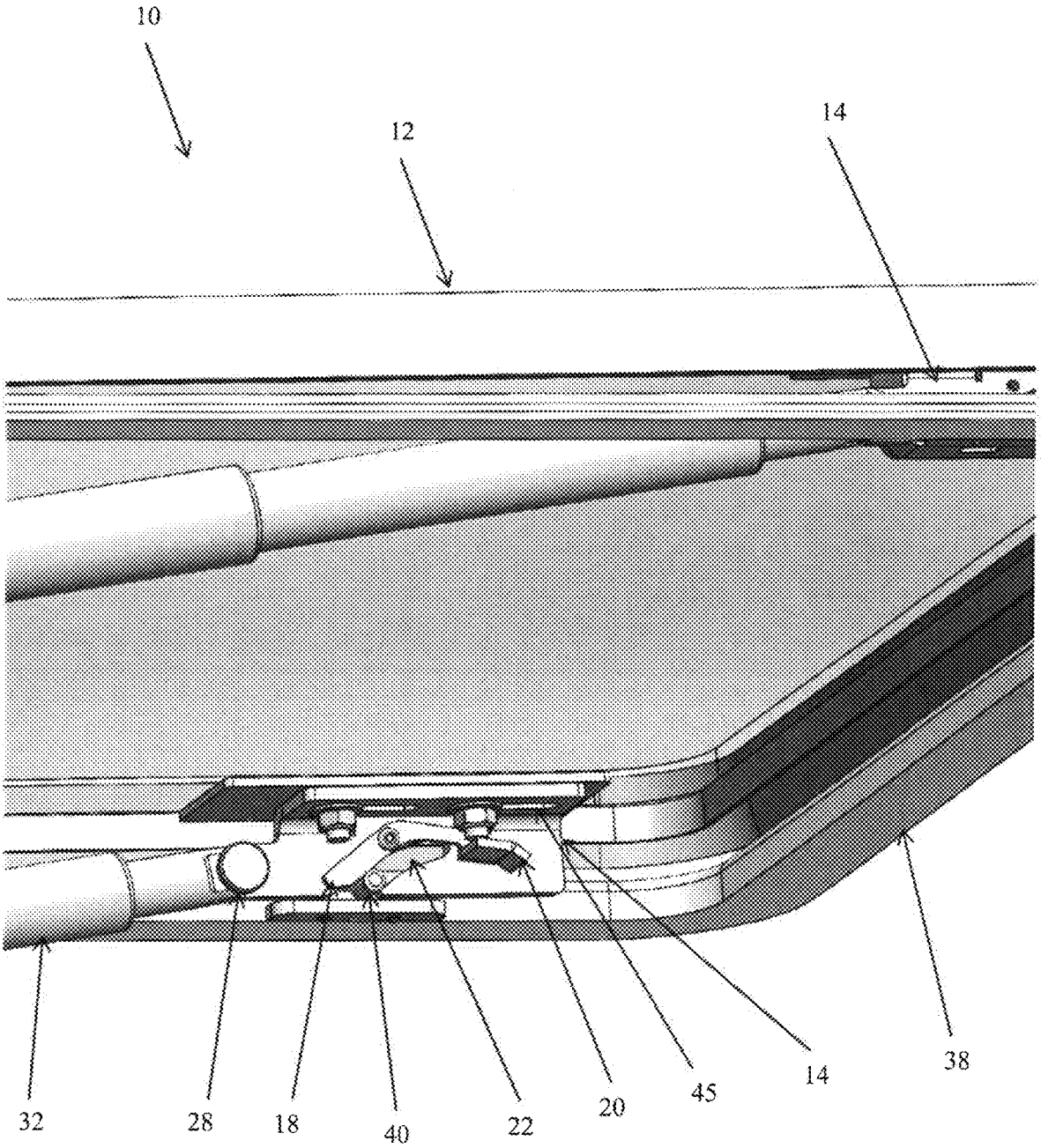
FIG. 22 is a partial perspective view generally illustrating an embodiment of a hatch power lift and locking system in a partially open position, in accordance with teachings of the present disclosure.
Figure 23:
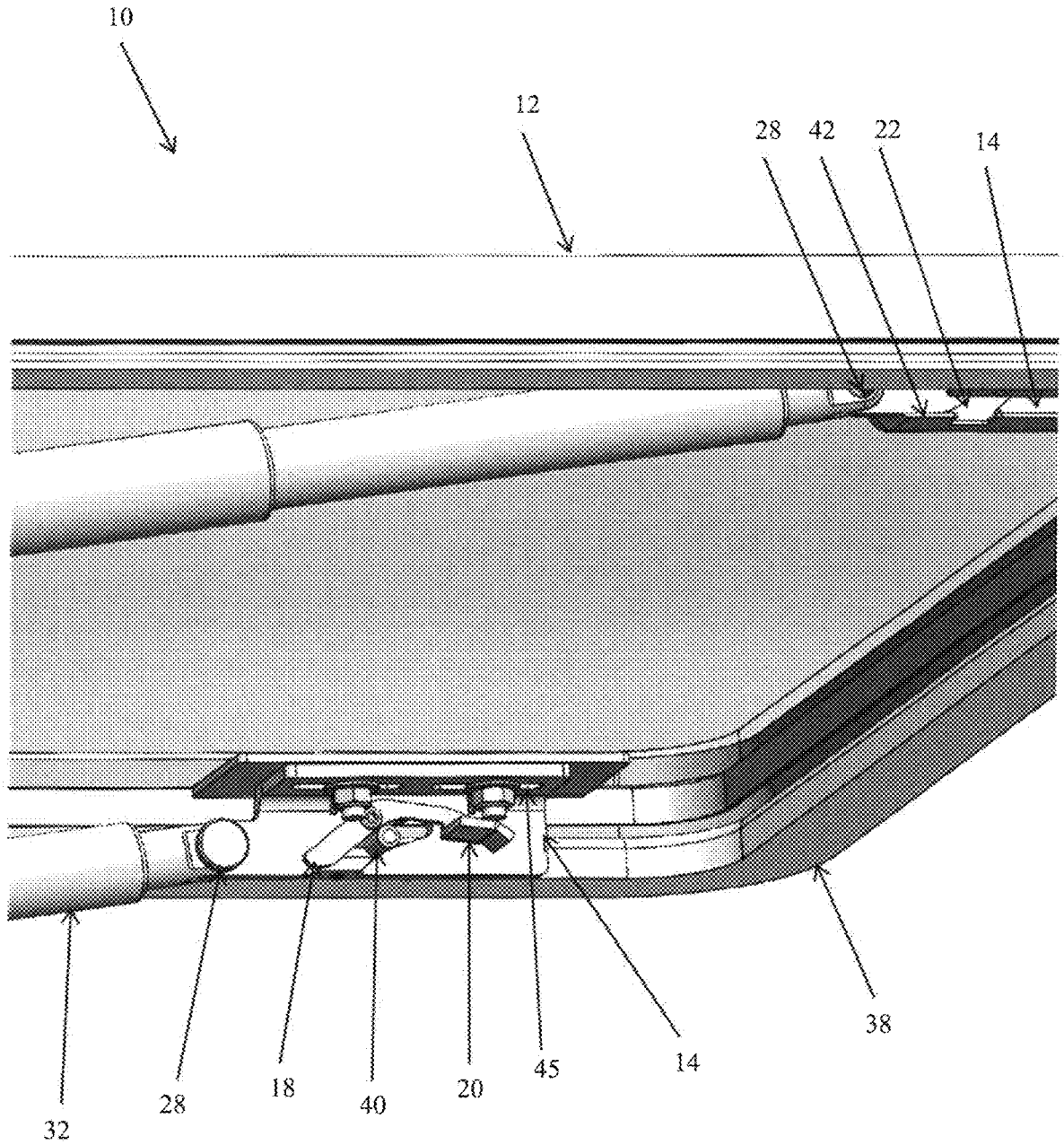
FIG. 23 is a partial perspective view generally illustrating an embodiment of a hatch power lift and locking system in a partially open position, in accordance with teachings of the present disclosure.
Figure 24:
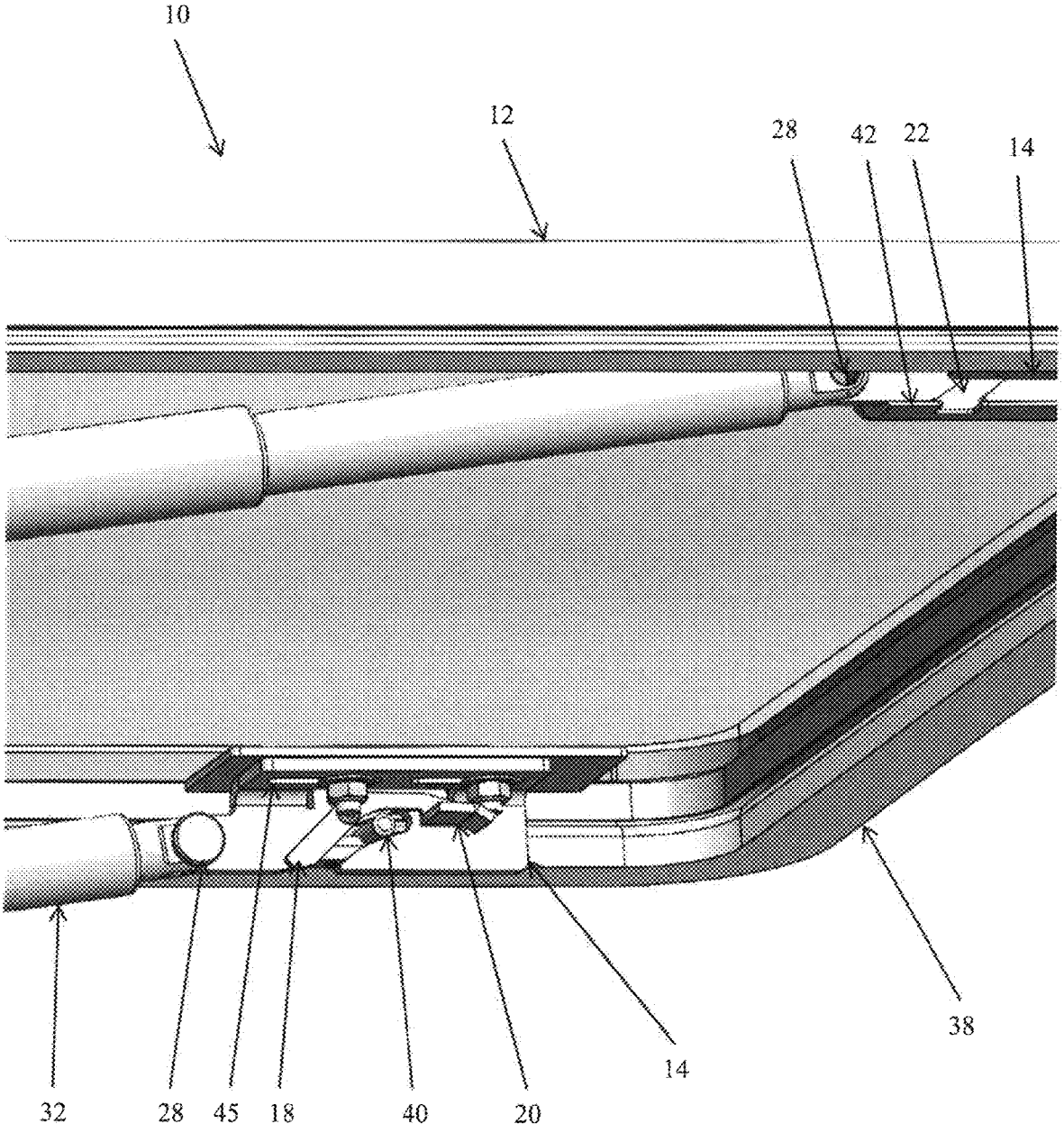
FIG. 24 is a partial perspective view generally illustrating an embodiment of a hatch power lift and locking system in a partially open position, in accordance with teachings of the present disclosure.

FIGS. 1 and 13 generally illustrate a hatch power lift and locking system 10 in an open (e.g., extended, deployed) position. In the open position, a hatch assembly 12 may be pivoted relative to one or more flexible joints (e.g., hinges) of a hatch frame 38. Hatch assembly 12 may be at least partially supported by one or more shafts 30 and/or actuators 32 that may be attached to hatch assembly 12 via one or more shaft axles 28. Shaft axles 28 may be connected to hatch assembly 12 directly and/or via one or more latch dogs 14. Latch dogs 14 may be connected to hatch assembly 12 via one or more fasteners 44 and/or may be configured to move via one or more fastener slots 45 (see FIGS. 18-25). In embodiments, fastener slots 45 may be configured to permit the movement of latch dogs 14 to move (e.g., slide) relative to hatch assembly 12. Actuators 32 may be configured to extend (e.g., deploy) shafts 30 (in the open position) and/or retract (e.g., withdraw) shafts 30 (in the closed position, see FIG. 26), described in further detail below. The load (e.g., weight) of hatch assembly 12 may be supported at least partially by shafts 30, actuators 32, and/or one or more brackets 36 that may be attached to a hatch frame 38. In embodiments, shafts 30 and/or actuators 32 may be attached directly to hatch frame 38, without one or more brackets 36.

FIGS. 2-11 and 14-24 generally illustrate a hatch power lift and locking system 10 in positions between fully open and closed (e.g., intermediate positions). A hatch assembly 12 may move from a fully open position (as shown in FIGS. 1 and 13) to positions that may be described as "partially open" and/or "partially closed". FIGS. 2-12 and 14-25 generally illustrate closing sequences; however, it should be understood reverse sequences (e.g., opening) may operate in a similar fashion.

A closing sequence as shown generally in FIGS. 2-11 and FIGS. 14-24 may begin with one or more actuators 32 receiving a signal and/or command to close. The signal and/or command may be provided from a mechanical and/or electrical system of a vehicle (e.g., boat, RV). For example and without limitation, a rain (e.g., water) sensor may send a signal to a control system of the vehicle that may subsequently send a signal to one or more actuators 32 to begin a closing sequence. Actuators 32 may begin by retracting shafts 30 into at least a portion of actuators 32. Shafts 30, connected to hatch assembly 12 via one or more latch dog axles and/or latch dogs 14, begin to move (e.g., rotate) hatch assembly 12 closer to a hatch frame 38 via one or more hinges that may join hatch assembly 12 and hatch frame 38.

As hatch assembly 12 may be drawn (e.g., pulled) toward hatch frame 38 by one or more shafts 30 and/or actuators 32 (see FIGS. 6-7 and 20-21), dog catch pin 40 may engage (e.g., contact) latch catch 18 and/or latch slot 22 of latch dog 14, including slot profile 24 and/or slot surface 26. Latch catch 18 may rotate (e.g., pivot) about latch catch axle 16, aligning (e.g., coinciding) with at least a portion of latch catch 18 with latch slot 22, slot profile 24, and/or slot surfaces 26. Hatch assembly 12 may approach hatch frame 38 more closely as the closing sequence continues, dog catch pin 40 may be forced (e.g., driven) further along (e.g., into) latch slot 22 and/or further engagement with latch catch 18. Dog catch pin 40 may engage (e.g., contact) one or more slot surfaces 26 that may define slot profile 26 of latch slot 22. Latch catch 18 may rotate about latch catch axle 16 as dog catch pin may continue to engage dog catch pin 40 due to the movement of hatch assembly 12 toward hatch frame 38 (see FIGS. 8-11 and 22-24).

FIGS. 8-11 and 22-24 generally illustrate hatch assembly 12 approaching a nearly-closed position relative to hatch frame 38. Dog catch pin 40 may be in continued engagement (e.g., follow, contact) with latch catch 18 and/or latch slot 22, including one or more slot surfaces 26 that may define slot profile 26 of latch slot 22. As latch catch stop 20 moves towards dog catch pin 40, latch catch 18 may rotate about latch catch axle 16. A portion of latch catch 18 may engage dog catch pin 40 as one or more actuators 32 draw hatch assembly 12 to a nearly closed position relative to hatch frame 38.

A closing sequence may be completed (e.g., hatch closed or "dogged") when one or more actuators 32 have drawn hatch assembly 12 in sealing engagement (e.g., closed contact) with hatch frame 38 due, for instance, to dog catch pin 40 reaching an end of latch slot 22. It is noted that in embodiments, a latch dog 14 may be configured to slide via fastener slots 45, and a corresponding dog catch pin 40 may, in relation, be stationary. Additionally and alternatively, one or more actuators 32 may stop drawing hatch assembly 12 toward hatch frame 38 due to a detection device (e.g., limit switch and/or amperage sensor switch) configured to monitor one or more actuators 32. Latch catch 18 and/or one or more actuators 32 may be configured to prevent hatch assembly 12 from being opened due undesired conditions (e.g., wind, water, unauthorized access).

Figure 12:
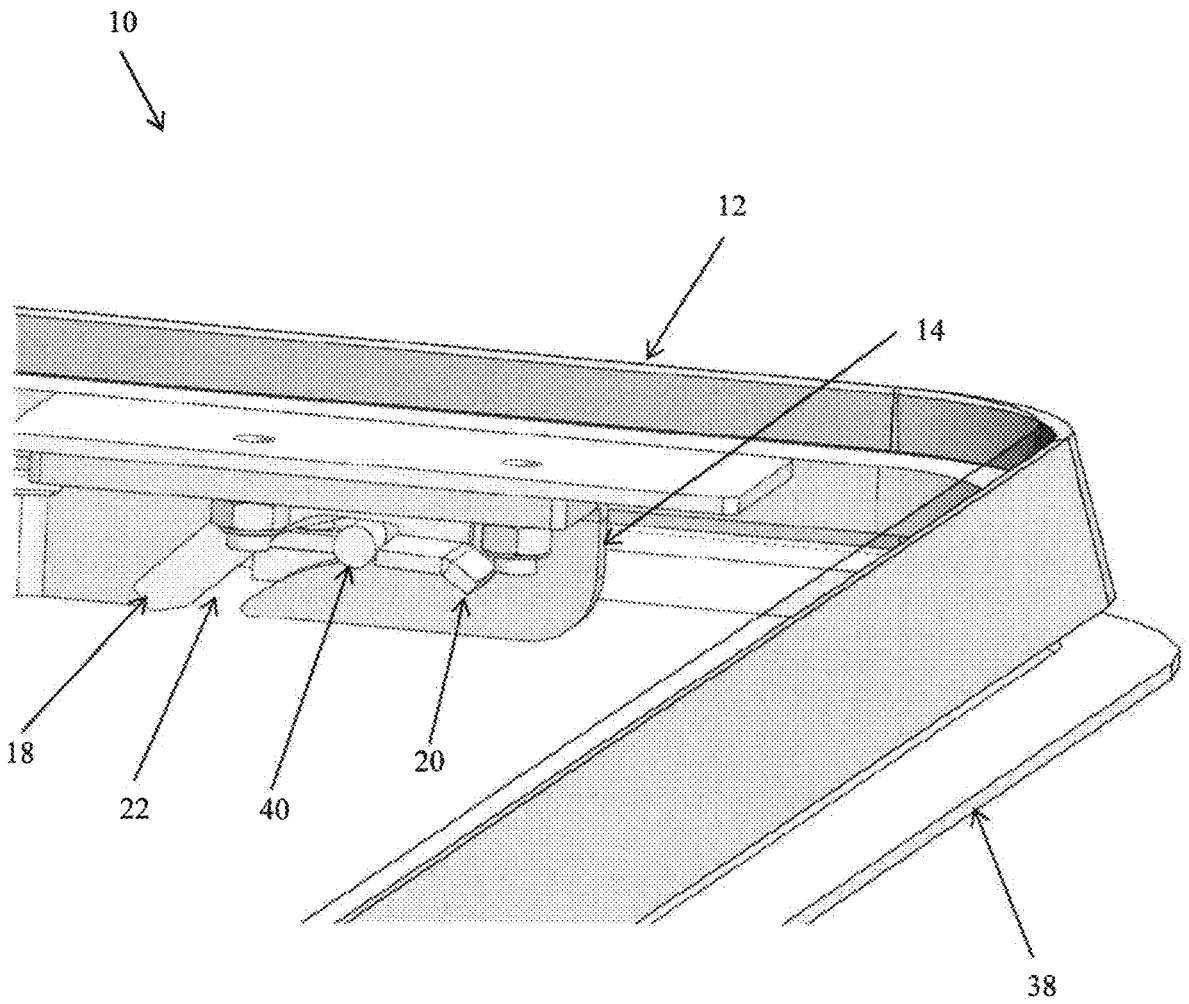
FIG. 12 is a partial perspective view generally illustrating an embodiment of a hatch power lift and locking system in a closed position, in accordance with teachings of the present disclosure.
Figure 25:
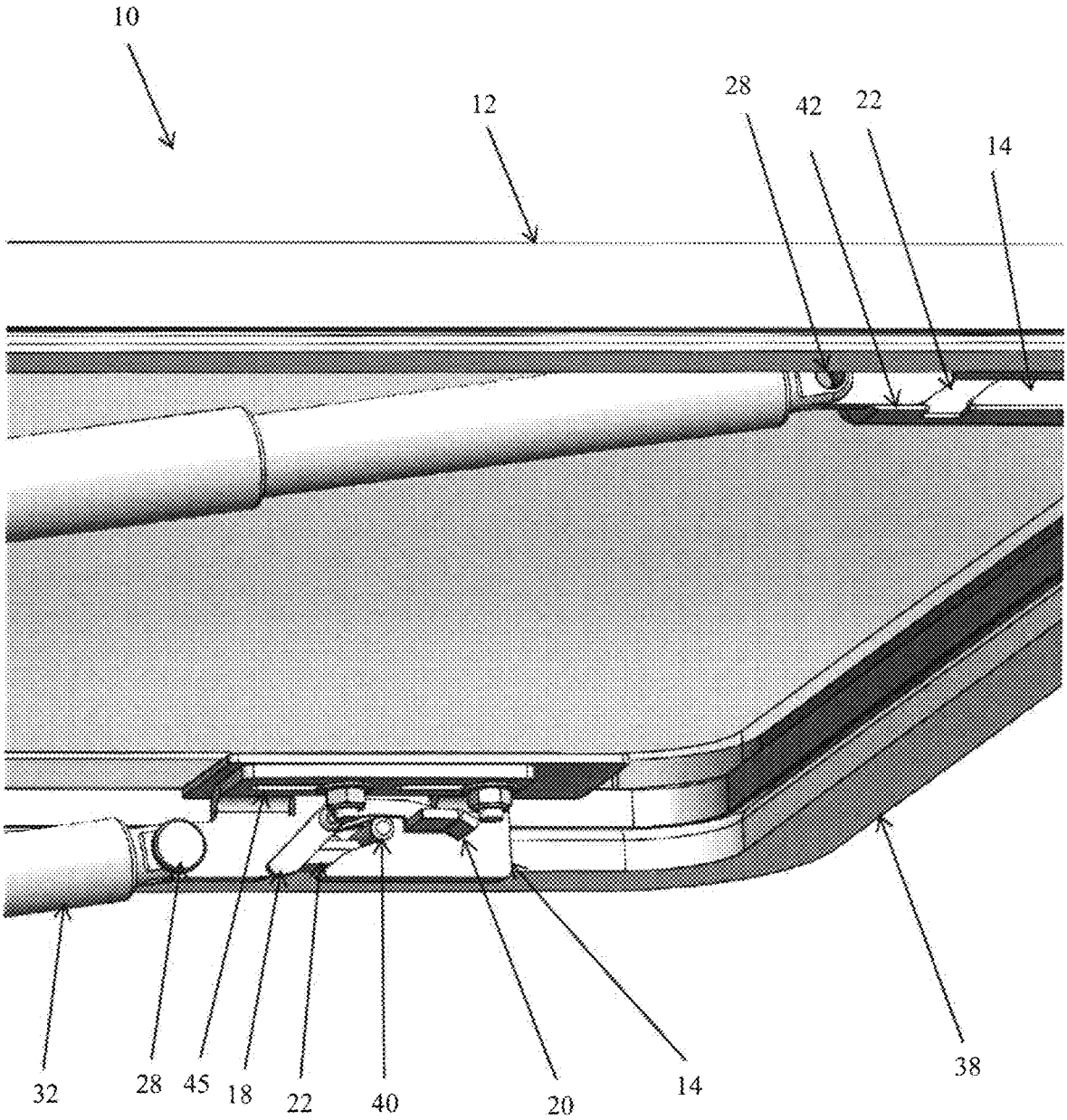
FIG. 25 is a partial perspective view generally illustrating an embodiment of a hatch power lift and locking system in a closed position, in accordance with teachings of the present disclosure.
Figure 26:
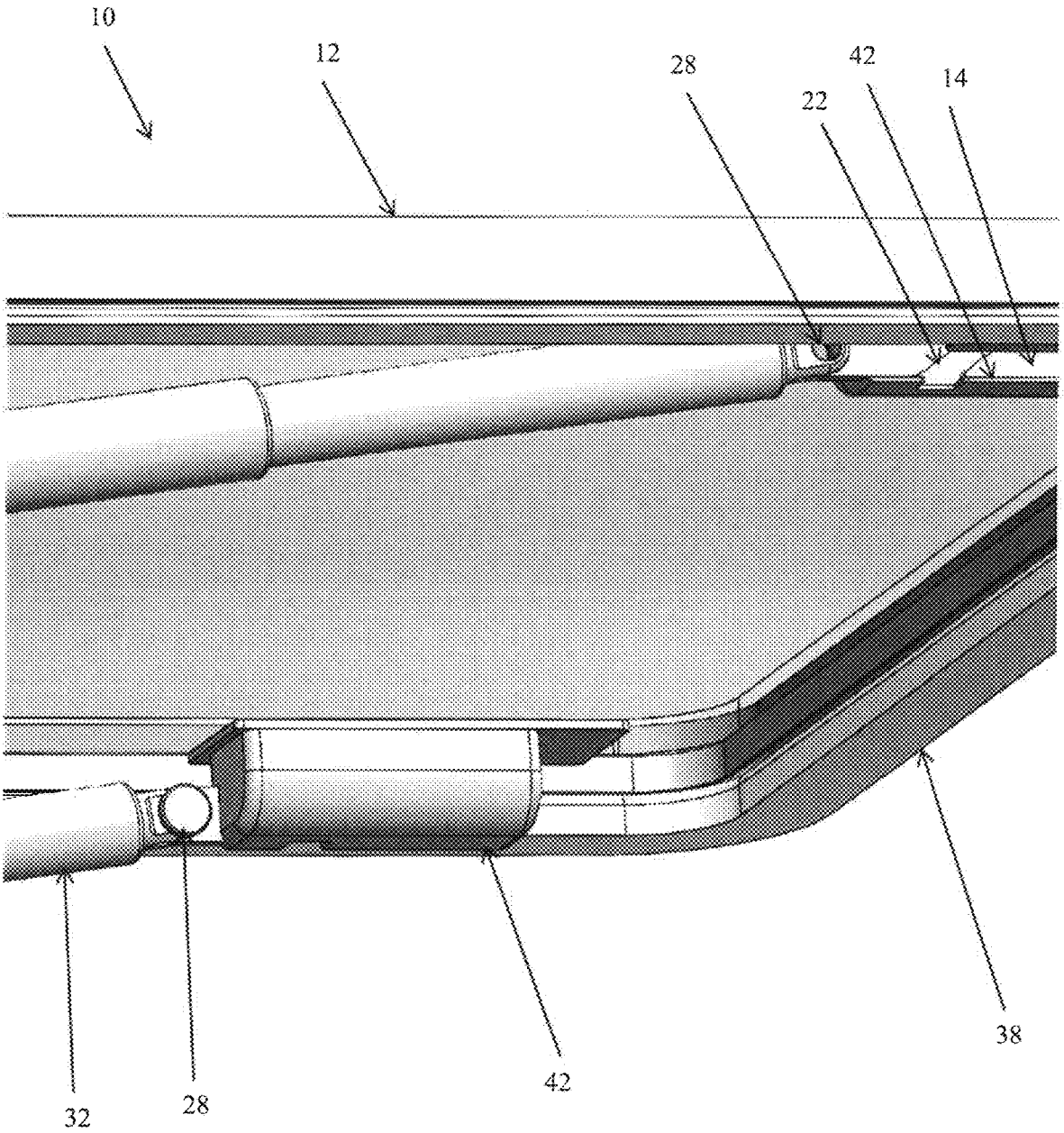
FIG. 26 is a partial perspective view generally illustrating an embodiment of a hatch power lift and locking system in a closed position, in accordance with teachings of the present disclosure.

An opening sequence from a closed position may be generally described as the reverse of the above closing description. FIGS. 12 and 25-26 may also be considered to be an initial step of an opening sequence. Hatch assembly 12 may be sealed to hatch frame 38. A signal and/or command may be sent to one or more actuators 32. Actuator 32 may activate and/or extend via a shaft 30, which may be incorporated within actuator 32 or separate component attached to actuator 32. Hatch assembly 12 may be rotated (e.g., lifted) relative to one or more flexible joints (e.g., hinges) that may join hatch assembly 12 to hatch frame 38. This rotational movement may cause latch catch 18 to engage dog catch pin 40 and/or may cause it to rotate about latch catch axle 16. Dog catch pin 40 may then engage latch catch stop 20 and latch slot 22 along latch slot profile 24 and/or latch slot surface 26. As actuator 32 continues to rotate hatch assembly 12 away from hatch frame 38, dog catch pin 40 may continue to approach the opening of latch slot 22 and/or may engage at least a portion of latch catch 18, causing latch catch 18 to rotate about latch catch axle 16 until the latch slot 22 clears dog catch pin 40. Actuator 32 may continue to lift hatch assembly to a specified or predetermined position (e.g., fully open, partially open).

Figure 27:
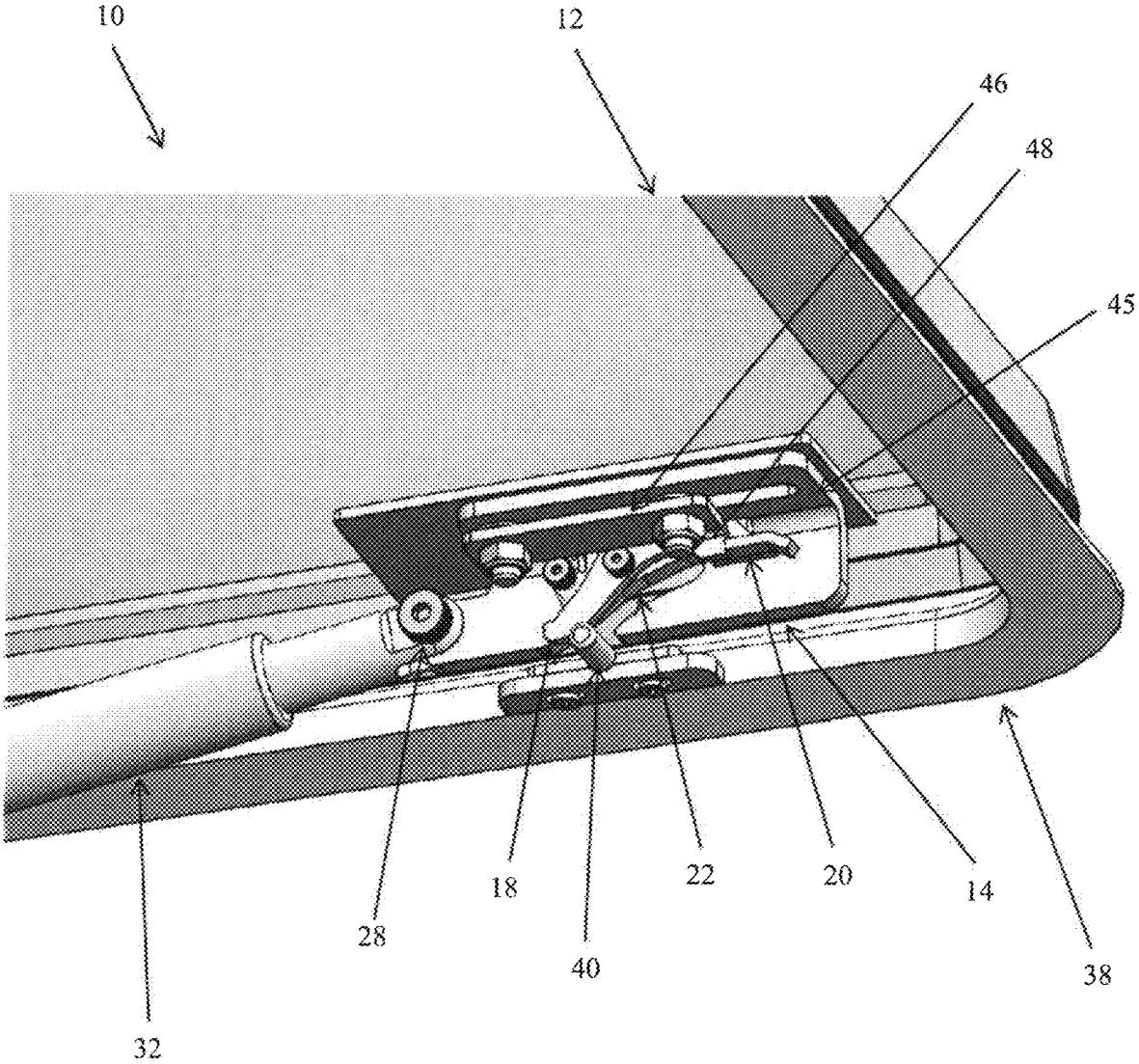
FIG. 27 is a partial perspective view generally illustrating an embodiment of a hatch power lift and locking system in a partially open position, in accordance with teachings of the present disclosure.
Figure 28:
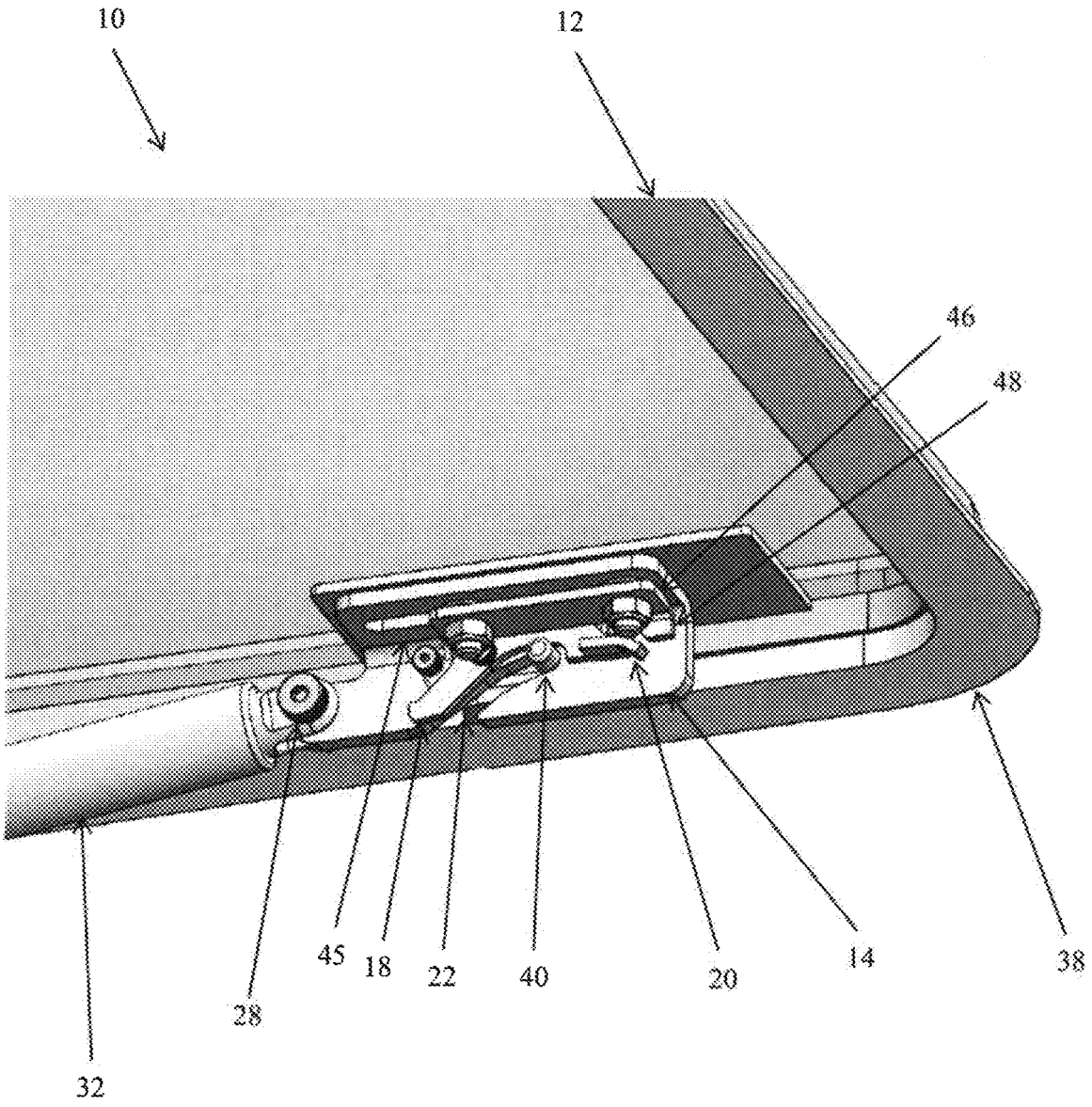
FIG. 28 is a partial perspective view generally illustrating an embodiment of a hatch power lift and locking system in a closed position, in accordance with teachings of the present disclosure.

In embodiments generally illustrated in FIGS. 27 and 28, the hatch assembly 12 may include a plate 46, which may be slidably attached to the latch dog 14 via the fasteners 44. The plate 46 may have a bent tab 48, which may engage the latch catch stop 20. For example, with the hatch open, and when dog catch pin 40 is not in contact with latch catch 18, as seen in FIG. 27, latch catch 18 or latch catch stop 20 can rotate (e.g., spring loaded) and engage the bent tab 48. This engagement may be in addition to or in lieu of the latch catch stop engaging the fasteners 44 and/or fastener slots 45 in a similar position or movement. While the bent tab 48 is illustrated bent from an edge of the plate 46 along the latch dog 14 and at a generally right angle, it should be appreciated that the bent tab 48 may have any configuration, including, but not limited to, being bent along an edge of the plate 46 orthogonal to the latch dog 14 and at an acute or obtuse angle.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "embodiments," "one embodiment," or "an embodiment," or the like, means that a particular feature, structure, or characteristic described in connection with the embodiment is included in at least one embodiment. Thus, appearances of the phrases "in various embodiments," "in embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It should be understood that references to a single element are not so limited and may include one or more of such element. All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure.

Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present teachings not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A power lift and locking assembly comprising:

a hatch configured to cover an opening, the hatch being pivotable about an axis between a closed position and an open position;

at least one latch dog attached to the hatch;

at least one dog catch pin engaging with the at least one latch dog in the closed position;

at least one actuator configured to move at least a portion of the hatch between the closed position and the open position; and at least one fastener slidably connecting the latch dog to the hatch;

wherein the at least one latch dog includes a latch slot for receiving the at least one dog catch pin, and a latch catch for engaging the at least one dog catch pin; the latch dog includes a latch catch stop configured to physically hold the latch dog from sliding, at least in one direction, when the hatch is in the open position; and the latch catch stop engages the at least one fastener to hold the latch dog from sliding when the hatch is in the open position.

2. The assembly of claim 1, including a hatch frame configured to sealingly fit within the opening, the hatch being engageable with the hatch frame to cover the opening.

3. The assembly of claim 2, including at least one seal configured to seal at least a portion of the hatch against at least a portion of the hatch frame.

4. The assembly of claim 2, wherein at least one of the at least one dog catch pin and the at least one actuator are attached to the hatch frame.

5. The assembly of claim 1, including at least one shaft engaging with the at least one actuator.

6. The assembly of claim 5, wherein the at least one shaft is at least one of collapsible into and extendable from at least one of itself and the at least one actuator.

7. The assembly of claim 5, wherein the at least one shaft engages with the at least one latch dog, and is pivotable about a shaft axle of the at least one latch dog.

8. The assembly of claim 5, wherein the at least one actuator is configured to operate the at least one shaft via at least one of a mechanical system and an electrical system.

9. The assembly of claim 1, wherein the at least one actuator is controlled via at least one of a mechanical system, an electrical system, an on-board system, and a remote system.

10. The assembly of claim 1, wherein the at least one actuator is pivotable about an actuator axle.

11. The assembly of claim 1, wherein the at least one actuator includes at least one safety mechanism to at least one of halt and reverse operation of the at least one actuator according to at least one predetermined characteristic.

12. The assembly of claim 1, wherein the at least one latch dog includes a latch catch axle about which the latch catch is pivotable when engaging the at least one dog catch pin.

13. The assembly of claim 1, wherein the hatch includes at least one fastener slot engaging with at least one fastener to attach the at least one latch dog to the hatch, the at least one latch dog being movable along the at least one fastener slot when engaging the dog catch pin.

14. A vehicle comprising:

a vehicle body with at least one opening therein;

at least one power lift and locking assembly including:

a hatch configured to cover the at least one opening, the hatch being pivotable about an axis between a closed position and an open position;

at least one latch dog attached to the hatch;

at least one dog catch pin engaging with the at least one latch dog in the closed position;

at least one actuator configured to move at least a portion of the hatch between the closed position and the open position; and at least one fastener slidably connecting the latch dog to the hatch;

wherein the at least one latch dog includes a latch slot for receiving the at least one dog catch pin, and a latch catch for engaging the at least one dog catch pin; and the latch dog includes a latch catch stop configured to physically hold the latch dog from sliding, at least in one direction, when the hatch is in the open position; and the latch catch stop engages the at least one fastener to hold the latch dog from sliding when the hatch is in the open position.

15. The vehicle of claim 14, wherein the at least one power lift and locking assembly includes at least one shaft engaging with the at least one actuator.

16. The vehicle of claim 14, including an on-board power system configured to connect with the at least one actuator.

17. The vehicle of claim 14, including at least one of an on-board electrical system and mechanical system configured to at least partially control the at least one actuator.

18. The assembly of claim 1, further comprising a plate slidably attached to the latch dog, the plate having a bent tab that engages the latch catch stop to hold the latch dog from sliding when the hatch is in the open position.

19. The assembly of claim 1, wherein the latch catch stop is at least one of rotatable and spring loaded.

* * * * *